US010780327B2

(12) United States Patent
Chao et al.

(10) Patent No.: US 10,780,327 B2
(45) Date of Patent: Sep. 22, 2020

(54) GOLF CLUB HEADS WITH TITANIUM ALLOY FACE

(71) Applicant: Taylor Made Golf Company, Inc., Carlsbad, CA (US)

(72) Inventors: Bing-Ling Chao, San Diego, CA (US); Matthew David Johnson, San Diego, CA (US); Matthew Greensmith, Vista, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 14 days.

(21) Appl. No.: 16/059,801

(22) Filed: Aug. 9, 2018

(65) Prior Publication Data

US 2019/0046844 A1 Feb. 14, 2019

Related U.S. Application Data

(60) Provisional application No. 62/543,778, filed on Aug. 10, 2017.

(51) Int. Cl.

| | |
|---|---|
| ***C22C 14/00*** | (2006.01) |
| ***A63B 53/04*** | (2015.01) |
| ***B22C 9/04*** | (2006.01) |
| ***B22D 13/04*** | (2006.01) |
| ***B22C 7/02*** | (2006.01) |

(52) U.S. Cl.

CPC ..... *A63B 53/0466* (2013.01); *B22C 7/02* (2013.01); *B22C 9/04* (2013.01); *B22D 13/04* (2013.01); *C22C 14/00* (2013.01); *A63B 2053/0408* (2013.01); *A63B 2053/0412* (2013.01); *A63B 2053/0433* (2013.01); *A63B 2053/0437* (2013.01); *A63B 2209/00* (2013.01)

(58) Field of Classification Search

CPC ..... B62B 2202/406; B62B 1/262; A63B 2053/0412; A63B 53/0466; A63B 53/04; A63B 2053/0491; A63B 2053/0458; A63B 53/02

See application file for complete search history.

(56) References Cited

U.S. PATENT DOCUMENTS

| | | | | |
|---|---|---|---|---|
| 6,001,495 | A * | 12/1999 | Bristow | A63B 53/04 428/660 |
| 6,739,376 | B1 | 5/2004 | Cheng et al. | |
| 6,789,304 | B2 | 9/2004 | Kouno | |
| 6,971,436 | B2 | 12/2005 | Huang | |
| 7,152,656 | B2 | 12/2006 | Huang et al. | |
| 7,360,578 | B2 | 4/2008 | Tseng | |
| 7,513,296 | B1 | 4/2009 | Yu et al. | |
| 8,020,606 | B2 | 9/2011 | Chao et al. | |

(Continued)

*Primary Examiner* — John E Simms, Jr.

(74) *Attorney, Agent, or Firm* — Kunzler Bean & Adamson

(57) ABSTRACT

Disclosed golf club head bodies are cast of 9-1-1 titanium with the face plate being cast as a unitary part of the body along the with crown, sole, skirt and hosel. Due to the 9-1-1 titanium material, the face plate and other portions of the body can have a reduced alpha case thickness and resulting greater durability. This can eliminate the need to reduce the alpha case thickness using hydrofluoric acid or other dangerous chemical etchants. Casting methods can include preheating the casting mold to a lower than normal temperature, to further reduce the amount of oxygen transferred from the mold to the 9-1-1 titanium during casting.

23 Claims, 20 Drawing Sheets

(56) References Cited

U.S. PATENT DOCUMENTS 8,939,192 B2 1/2015 Solesbee et al.
9,387,376 B1 * 7/2016 Hall ..... A63B 53/06
9,545,545 B2 1/2017 Li
9,545,546 B2 1/2017 Li
9,545,661 B2 1/2017 Li
9,687,703 B2 6/2017 Li
9,687,704 B2 6/2017 Li
9,931,550 B1 4/2018 Seluga et al.
2003/0104878 A1 * 6/2003 Yabu ..... A63B 53/04 473/345
2004/0082405 A1 * 4/2004 Sano ..... A63B 53/04 473/342
2004/0116208 A1 * 6/2004 De Shiell ..... A63B 53/0466 473/345
2004/0138001 A1 * 7/2004 Sano ..... A63B 53/0466 473/324
2005/0034834 A1 2/2005 Huang
2005/0224207 A1 10/2005 Huang
2007/0079946 A1 4/2007 Lin
2008/0020858 A1 * 1/2008 Kusumoto ..... A63B 53/0466 473/316
2009/0088271 A1 * 4/2009 Beach ..... A63B 53/0466 473/350
2009/0280926 A1 * 11/2009 Hirano ..... A63B 53/0466 473/342
2010/0029402 A1 * 2/2010 Noble ..... A63B 53/0466 473/291
2010/0248860 A1 * 9/2010 Guerrette ..... A63B 53/047 473/345
2010/0290944 A1 * 11/2010 Lin ..... A63B 53/04 420/420
2012/0077617 A1 * 3/2012 Hu ..... A63B 53/0466 473/349
2012/0157227 A1 * 6/2012 Morin ..... A63B 53/0466 473/330
2012/0190474 A1 * 7/2012 Sato ..... A63B 53/02 473/305
2014/0080632 A1 * 3/2014 Deshmukh ..... A63B 53/0466 473/342
2014/0080633 A1 * 3/2014 Bezilla ..... A63B 53/06 473/342
2014/0256464 A1 * 9/2014 Chao ..... A63B 53/0466 473/335
2014/0283364 A1 * 9/2014 Chiang ..... C22C 14/00 29/527.1
2015/0190687 A1 * 7/2015 Clausen ..... A63B 60/00 473/332
2016/0067563 A1 * 3/2016 Murphy ..... A63B 53/0466 473/349
2016/0175666 A1 * 6/2016 Chao ..... A63B 53/0466 164/129
2016/0279489 A1 * 9/2016 Seluga ..... A63B 53/0466
2016/0375326 A1 * 12/2016 Nunez ..... A63B 60/52 473/335

* cited by examiner

| | Caster 1 | Caster 2 | Caster 3 | Caster 4 | Caster 5 | Caster 6 |
|---|---|---|---|---|---|---|
| Degree of complexity of cluster | 1 | 3 | 2 | 2 | 2 | 5 |
| A max (m) | 0.15 | 0.38 | 0.42 | 0.42 | 0.42 | 0.6 |
| A min (m) | NA | 0.28 | 0.24 | 0.24 | 0.24 | 0.3 |
| Major runner cross section | 21 mm, 23 mm | 22 mm, 30 mm | 22 mm, 22 mm | 26 mm | 33 mm, 33 mm | 20 mm, 45 mm |
| Main gate cross section | 22 mm, 21 mm | 23 mm, 20 mm | 23 mm, 20 mm | 23 mm, 20 mm | 23 mm, 20 mm | 22 mm, 30 mm |
| Runner cross sectional area ($m^2$) | 0.000483 | 0.00066 | 0.000209 | 0.000616 | 0.000471 | 0.0009 |
| Wet perimeter (m) | 0.088 | 0.104 | 0.066 | 0.067962 | 0.999000 | 0.13 |
| Gate cross sectional area ($m^2$)[02] | 0.000462 | 0.00092 | 0.00092 | 0.00092 | 0.00092 | 0.00132 |
| Interface getting ratio (%) runner-to-gate[03] | 104.55% | 71.74% | 22.72% | 86.93% | 51.24% | 68.16% |
| R (flow radius) of runner (m) | 0.0054 | 0.0063 | 0.0032 | 0.0070 | 0.0048 | 0.0059 |
| Sharp turn | 1 | 2 | 2 | 2 | 2 | 3 |
| Rotation (mm) | 505 | 370 | 380 | 380 | 380 | 340 |
| Shell preheat temp($^0$C) | 900 | 750 | 750 | 750 | 750 | 500 |
| Angular speed ω (rad/sec) | 52.88 | 36.75 | 39.79 | 39.79 | 35.79 | 35.60 |
| Pouring material (kg) | 9.3 | 39.2 | 35 | 32 | 32 | 72.2 |
| Casting pieces | 14 | 48 | 48 | 48 | 48 | 96 |
| Process loss(kg) | 3.9 | 6 | 7.5 | 7.5 | 7.5 | 10 |

FIG. 16

| | | | | | | |
|---|---|---|---|---|---|---|
| Actual available filling material (kg) | 5.4 | 33.2 | 27.5 | 24.5 | 24.5 | 62.2 |
| Material usage (kg/pc) (w/o process loss) | 0.664 | 0.817 | 0.729 | 0.667 | 0.667 | 0.752 |
| Material usage (kg/pc) (w/ process loss) | 0.386 | 0.692 | 0.573 | 0.510 | 0.510 | 0.648 |
| Process loss ratio | 41.9% | 15.3% | 21.4% | 23.4% | 23.4% | 13.9% |
| Velocity max (m/s) | 7.93 | 14.72 | 16.71 | 16.71 | 16.71 | 14.24 |
| Velocity min (m/s) | NA | 10.85 | 9.55 | 9.55 | 9.55 | 9.61 |
| Acceleration max ($m/s^2$) | 419.47 | 570.45 | 665.04 | 655.04 | 665.04 | 507.05 |
| Acceleration min ($m/s^3$) | NA | 420.33 | 380.02 | 380.02 | 380.02 | 342.26 |
| Force max (N1) | 161.80 | 394.56 | 381.01 | 339.45 | 339.45 | 328.53 |
| Force min (N1) | NA | 290.73 | 217.72 | 193.97 | 193.97 | 221.75 |
| Pressure max (Pa) | 334984.13 | 597821.56 | 1823027.72 | 551289.62 | 720076.71 | 365027.92 |
| Pressure min (Pa) | NA | 316010.94 | 236653.91 | 210837.12 | 210637.12 | 157995.81 |
| Kinetic energy max (J) | 12.13 | 74.97 | 80.01 | 71.28 | 71.23 | 65.71 |
| Density (MP) ($g/cm^2$) | 4.11 | 4.11 | 4.11 | 4.11 | 4.11 | 4.11 |
| Viscosity (MP) ($g/cm^2sec$) | 0.033 | 0.033 | 0.033 | 0.033 | 0.033 | 0.033 |
| Renumber max | 212075.72 | 455478.47 | 263556.77 | 582820.22 | 395456.52 | 491181.21 |
| Renumber min | NA | 342884.14 | 150681.01 | 333040.13 | 226548.68 | 331547.32 |
| Casting yield | 94% | 93% | 78% | 94% | 94% | 89% |

FIG. 17

GOLF CLUB HEADS WITH TITANIUM ALLOY FACE

CROSS-REFERENCE TO RELATED APPLICATIONS

This application claims the benefit of U.S. Provisional Patent Application No. 62/543,778, filed Aug. 10, 2017, which is incorporated by reference herein in its entirety.

FIELD

This disclosure relates to golf club heads having a titanium alloy face, and such as where the face and body are integrally cast together.

BACKGROUND

With the ever-increasing popularity and competitiveness of golf, substantial effort and resources are currently being expended to improve golf clubs. Much of the recent improvement activity has involved the combination of the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods."

The current ability to fashion metalwood club-heads of strong, light-weight metals and other materials has allowed the club-heads to be made hollow. Use of materials of high strength and high fracture toughness has also allowed club-head walls to be made thinner, which reduces total weight and allows increases in club-head size, compared to earlier club-heads without the swing speed penalty resulting from increased weight. Larger club-heads tend to have a larger face plate area and can also be made with high club-head inertia, thereby making the club-heads more "forgiving" than smaller club-heads. Characteristics such as size of the optimum impact location (also known as the "sweet spot") are determined by many variables including the shape, profile, size and thickness of the face plate as well as the location of the center of gravity (CG) of the club-head.

An exemplary metalwood golf club typically includes a shaft having a lower end to which the club-head is attached. Most modern versions of these club-heads are made, at least in part, of a light-weight but strong metal such as titanium alloy. In some cases, the club-head comprises a body to which a face plate (used interchangeably herein with the terms "face" or "face insert" or "striking plate" or "strike plate") is later attached, while in other cases the body and face place are cast together as a unitary structure, such that the face plate does not have to be later attached to the body. The face plate defines a front surface or strike face that actually contacts the golf ball.

Regarding the total mass of the metalwood club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the metalwood club-head to address performance issues, for example. Thus the ability to reduce the structural mass of the metalwood club-head without compromising strength and structural support provides the potential for increasing discretionary mass and hence improved club performance.

One opportunity to reduce the total mass of the club head is to lower the mass of the face plate by reducing its thickness; however opportunities to do this are somewhat limited given that the face absorbs the initial impact of the ball and thus has quite rigorous requirements on its physical and mechanical properties. Club manufacturers have used titanium and titanium alloys for face plate manufacture as well as whole club head manufacture, given their lightness and high strength. Typically for the club head given its relatively complex 3-D structure, casting processes have been used for its manufacture. Many such face plates are made by the investment casting process wherein an appropriate metal melt is cast into a preheated ceramic investment mold formed by the lost wax process. Investment casting has also been used to prepare the face plate either as a unitary structure cast with the rest of the club head body or as separately formed face plate which is then attached to the front of the club head body, usually by welding. Although widely used, investment casting of complex shaped components of such reactive materials can be characterized by relatively high costs and low yields. Low casting yields are attributable to several factors including surface or surface-connected void type defects and/or inadequate filling of certain mold cavity regions, especially thin mold cavity regions, and associated internal void, shrinkage and like defects.

To further compound the deficiencies of investment casting the face plate, club head manufacturers often also introduce curvature onto the face of the club to help compensate for directional problems caused by shots hit other than where the center of gravity is located. Thus rather than planar face plate manufacturers may wish to form the face with both a heel-to-toe convex curvature (referred to as "bulge") and a crown-to-sole convex curvature (referred to as "roll"). In addition manufacturers may also introduce variable face thickness profiles across the face plate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for reallocation to another area of the club head.

In order to make up for the deficiencies of investment casting these more complex face plate structures, manufacturers have turned to alternative methods of forming the face plate including laser cutting the face plate shape from a rolled titanium sheet followed by subsequent forging to impart any desired bulge and roll followed by a machining step on a lathe to introduce any desired face thickness profile. Disadvantages of these steps include the fact that three separate forming steps are needed and the machining process on a lathe to form variable thickness profiles is not only wasteful but also limits the profiles to circular shaped areas as a result of the circular motion of the lathe.

Thus it would be highly desirable to have club head face plates with sufficient physical properties to allow reduction in thickness to result in more available discretionary weight in a club head. It would also be desirable if the face plates were also able to exhibit any desired bulge and roll curvature in addition to any variable thickness profile having any shape—circular, oval, asymmetrical or otherwise. It would also be desirable if a simplified process for manufacture of such face plates could be employed which would result in face plate with the required thickness and physical strength properties which process would also result in a face plate with any desired bulge and roll and variable thickness profile while requiring a minimum of processing steps and minimizing any waste produced in the process. It would also be desirable if the club head body and the face could be cast at the same time from the same material as a single unitary body, rather than two pieces that must be later attached together. It would also be desirable if the cast face plate did not require chemical etching to remove or reduce the thickness of the alpha case to provide adequate durability properties for the face plate.

SUMMARY

Some golf club head bodies disclosed herein can be cast of 9-1-1 titanium with the face plate being cast as a unitary part of the body along the with crown, sole, skirt and hosel. Due to the 9-1-1 titanium material, the face plate and other portions of the body acquire less oxygen from the mold and can have a reduced alpha case thickness, resulting in greater ductility and durability. This can eliminate the need to reduce the alpha case thickness after casting using hydrofluoric acid or other dangerous chemical etchants. Casting methods can include preheating the casting mold to a lower than normal temperature and/or coating an inner surface of the mold, to further reduce the amount of oxygen transferred from the mold to the 9-1-1 titanium during casting.

In some embodiments, a wood-type golf club head body comprises a crown, a sole, skirt, a face plate, and a hosel; the body defines a hollow interior region; the body is cast substantially entirely of 9-1-1 titanium; and the body is cast as a single unitary casting, with the face plate being formed integrally with the crown, sole, skirt, and hosel. The body may comprise trace fluorine atoms as alloying impurities found in the titanium alloy, but due to the absence of etching the face with hydrofluoric acid after casting, the content of fluorine present in the body can be very low. In some embodiments, the face plate can have substantially no fluorine atoms, such as less than 1000 ppm, less than 500 ppm, less than 200 ppm, and or less than 100 ppm. In some embodiments, the body can have an alpha case thickness of 0.150 mm or less, 0.100 mm or less, and/or 0.070 mm or less.

Some exemplary methods comprise preparing a mold for casting and then casting a golf club head body substantially entirely of 9-1-1 titanium using the mold, wherein the cast body includes a crown, a sole, skirt, a face plate, and a hosel, wherein the cast body defines a hollow interior region; and wherein the body is cast as a single unitary casting, with the face plate being formed integrally with the crown, sole, skirt, and hosel during the casting. Some such methods do not include etching the face plate after the casting. In some methods, preparing the mold comprises preheating the mold such that the mold is at a temperature of 800 C or less, 700 C or less, 600 C or less, and/or 500 C or less, when the casting occurs.

The foregoing and other objects, features, and advantages of the disclosed technology will become more apparent from the following detailed description, which proceeds with reference to the accompanying figures.

BRIEF DESCRIPTION OF THE DRAWINGS

FIG. 16 is a table for casting data for titanium alloy obtained for six different casters.

FIG. 17 a continuation of the table of FIG. 16.

DETAILED DESCRIPTION

Figure 1:
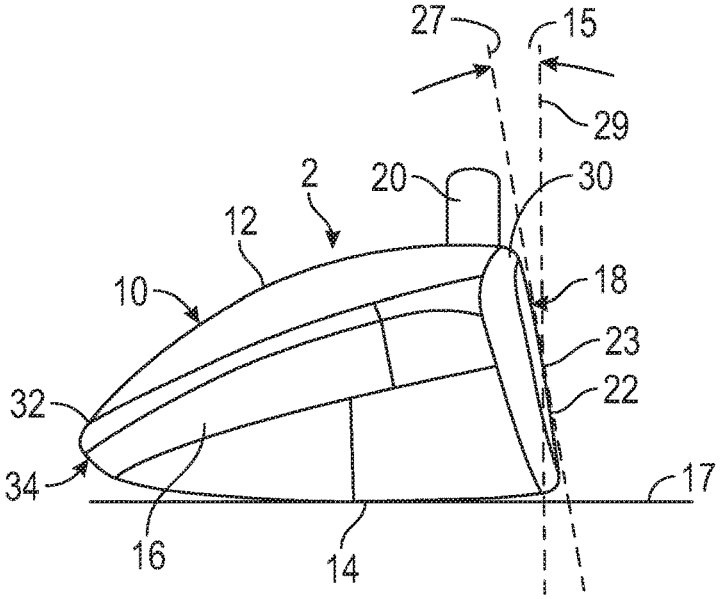
FIG. 1 is a side elevation view of a golf club head.
Figure 2:
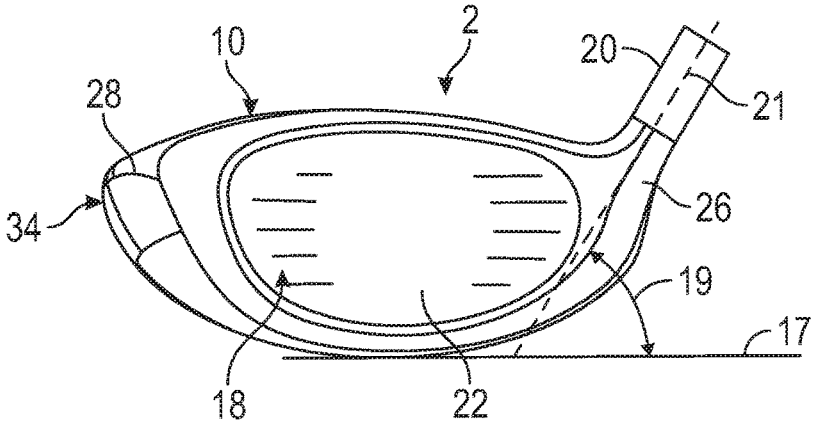
FIG. 2 is a front elevation view of the golf club head of FIG. 1.
Figure 3:
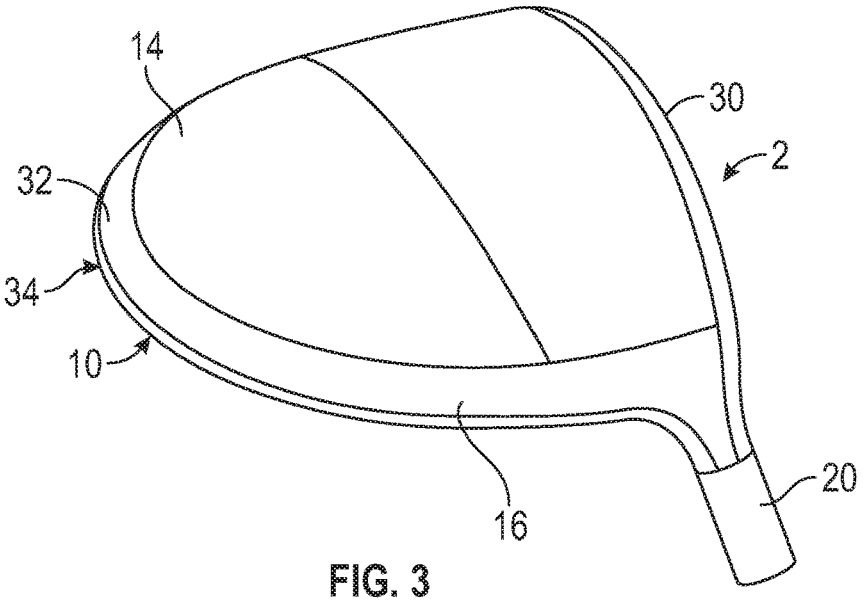
FIG. 3 is a bottom perspective view of the golf club head of FIG. 1.

The following describes embodiments of golf club heads for metalwood type golf clubs, including drivers, fairway woods, rescue clubs, utility clubs, hybrid clubs, and the like.

The inventive features disclosed herein include all novel and non-obvious features disclosed herein both alone and in combinations with any other features. As used herein, the phrase "and/or" means "and", "or", and both "and" and "or". As used herein, the singular forms "a," "an," and "the" refer to one or more than one, unless the context clearly dictates otherwise. As used herein, the term "includes" means "comprises."

The following also makes reference to the accompanying drawings which form a part hereof. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the herein-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

For reference, within this disclosure, reference to a "driver type golf club head" means any metalwood type golf club head intended to be used primarily with a tee. In general, driver type golf club heads have lofts of 15 degrees or less, and, more usually, of 12 degrees or less. Reference to a "fairway wood type golf club head" means any wood type golf club head intended to be used with or without a tee. In general, fairway wood type golf club heads have lofts of 15 degrees or greater, and, more usually, 16 degrees or greater. In general, fairway wood type golf club heads have a length from leading edge to trailing edge of 73-97 mm. Various definitions distinguish a fairway wood type golf club head from a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Driver type golf club heads of the current disclosure may be 15 degrees or less in various embodiments or 10.5 degrees or less in various embodiments. In various embodiments, fairway wood type golf club heads of the current disclosure may be from 13-26 degrees.

As illustrated in FIGS. 1-6, a wood-type (e.g., driver or fairway wood) golf club head, such as golf club head 2, can include a hollow body 10. The body 10 can include a crown 12, a sole 14, a skirt 16, and a face plate 18 (also referred to as a face or face portion) defining striking surface 22, while defining an interior cavity. The face plate 18 may be integrally formed as a unitary part of the body 10, rather than formed separately and later attached to an opening at the front of the body. The body 10 can include a hosel 20, which defines a hosel bore 24 adapted to receive a golf club shaft (see FIG. 6). The body 10 further includes a heel portion 26, a toe portion 28, a front portion 30, and a rear portion 32.

Figure 4:
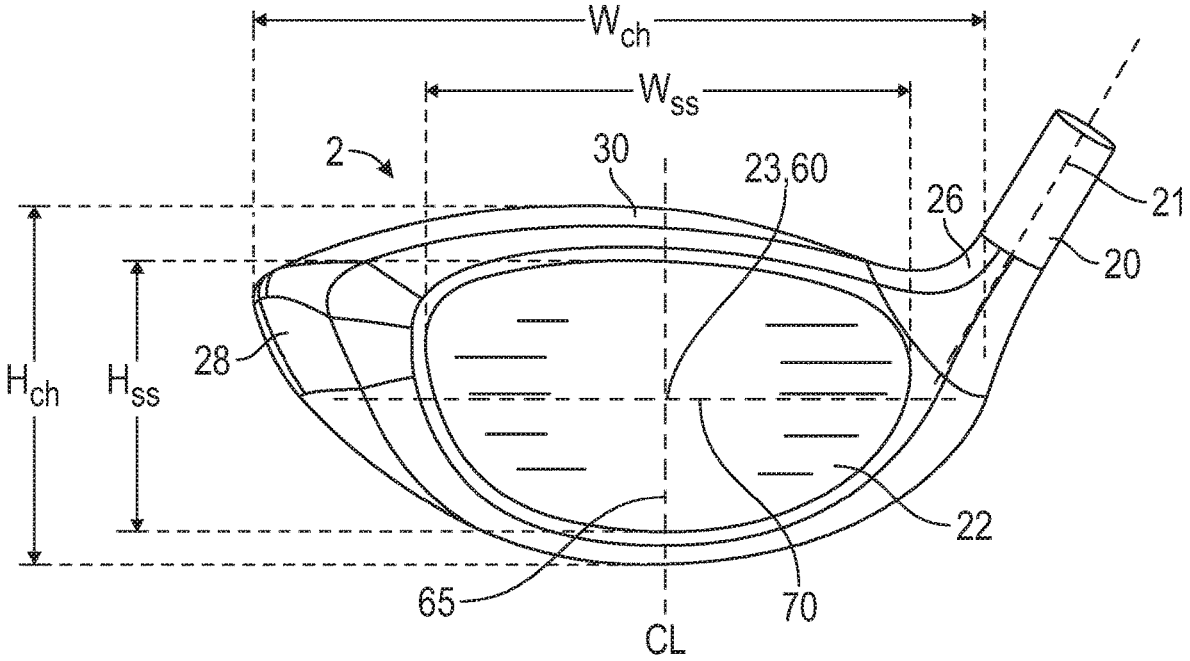
FIG. 4 is a front elevation view of the golf club head of FIG. 1 showing a golf club head origin coordinate system.
Figure 5:
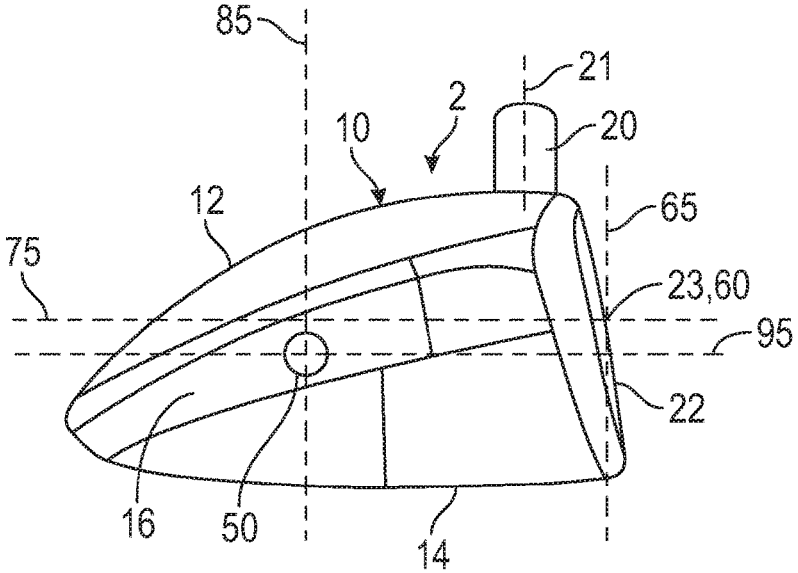
FIG. 5 is a side elevation view of the golf club head of FIG. 1 showing a center of gravity coordinate system.
Figure 6:
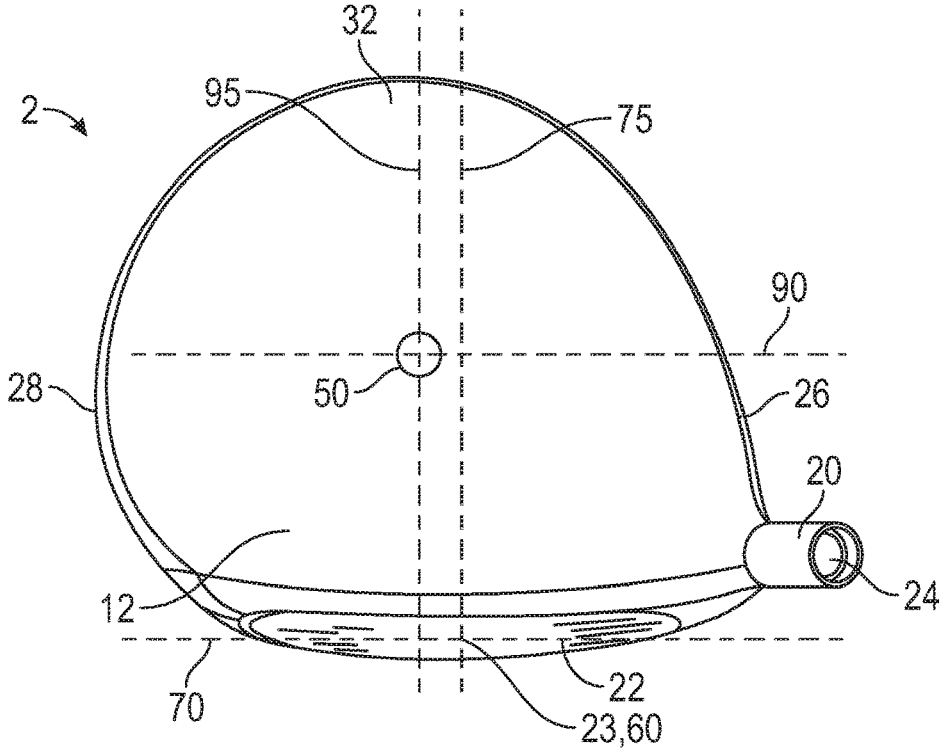
FIG. 6 is a top plan view of the golf club head of FIG. 1.

FIGS. 4-6 illustrate an ideal impact location/origin 23, 60, an origin x axis 70, an origin y axis 75, and origin z axis 65, a center of gravity 50 of the club head, a CG x axis 90, a CG y axis 95, and a CG z axis 85. These axes are horizontal or vertical while the club head is in the normal address position, as shown. The origin axes pass through the origin 60, and the CG axes pass through the CG 50.

The body may further include openings in the crown and/or sole that are overlaid or covered by inserts formed of lighter-weight material, such as composite materials. For example, the crown of the body can comprise a composite crown insert that covers a large portion of the area of the crown and has a lower density that the metal the body is made out of, thereby saving weight in the crown. Similarly, the sole can include one or more openings in the body that are covered by sole inserts made of composite material. In embodiments where the body includes openings in the crown or sole, such openings can provide access to the inner cavity of the club head during manufacturing, especially where the face plate is formed as an integral part of the body during casting (and there is not a face opening in the body to provide access during manufacturing). The club heads disclosed herein in relation to FIGS. 20-36 provide examples of openings in the crown and sole that are overlaid or covered by inserts formed of lighter-weight material (e.g., composite materials). More information regarding openings in the body and related inserts can be found in U.S. Patent Publication 2018/0185719, published Jul. 5, 2018, and in U.S. Provisional Application No. 62/515,401, filed Jun. 5, 2017, both of which are incorporated by reference herein in their entireties.

In some embodiments, the club head can comprise adjustable weights, such as one or more weights movable along weight tracks formed in the sole of the club head. Various ribs, struts, mass pads, and other structures can be included inside the body to provide reinforcement, adjust mass and MOI properties, adjust acoustic properties, and/or for other reasons.

The wood-type club head 2 has a volume, typically measured in cubic-centimeters ($cm^3$), equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In the case of a driver, the golf club head can have a volume between approximately 300 $cm^3$ and approximately 490 $cm^3$, and can have a total mass between approximately 145 g and approximately 245 g. In the case of a fairway wood, the golf club head 2 can have a volume between approximately 120 $cm^3$ and approximately 250 $cm^3$, and can have a total mass between approximately 145 g and approximately 260 g. In the case of a utility or hybrid club the golf club head 2 can have a volume between approximately 80 $cm^3$ and approximately 140 $cm^3$, and can have a total mass between approximately 145 g and approximately 280 g.

The sole 14 is defined as a lower portion of the club head 2 extending upwards from a lowest point of the club head when the club head is ideally positioned, i.e., at a proper address position relative to a golf ball on a level surface. In some implementations, the sole 14 extends approximately 50% to 60% of the distance from the lowest point of the club head to the crown 12, which in some instances, can be approximately 15 mm for a driver and between approximately 10 mm and 12 mm for a fairway wood.

Materials which may be used to construct the body 10, including the face plate 18, can include composite materials (e.g., carbon fiber reinforced polymeric materials), titanium or titanium alloys, steels or alloys of steel, magnesium alloys, copper alloys, nickel alloys, and/or any other metals or metal alloys suitable for golf club head construction. Other materials, such as paint, polymeric materials, ceramic materials, etc., can also be included in the body. In some embodiments, the body including the face plate can be made of a metallic material such as titanium or titanium alloys (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075), Ti Grade 9 (Ti-3Al-2.5V) having a chemical composition of ≤3.5-2.5% Al; ≤3.0-2.0% V; ≤0.02% N; ≤0.013% H; ≤0.12 Fe.

Aspects of Investment Casting

Injection molding is used to form sacrificial "initial" patterns (e.g., made of casting "wax") of the desired castings. A suitable injection die can be made of aluminum, or other suitable metal or metal alloy, or other material, e.g., by a computer-controlled machining process using a casting master. CNC (computer numerical control) machining can be used to form the intricacies of the mold cavity in the die. The cavity dimensions are established so as to compensate for linear and volumetric shrinkage of the casting wax encountered during casting of the initial pattern and also to compensate for any similar shrinkage phenomena expected to be encountered during actual metal casting performed later using an investment-casting "shell" formed from the initial pattern.

Usually, a group of initial patterns is assembled together and attached to a central wax sprue to form a casting "cluster." Each initial pattern in the cluster forms a respective mold cavity in the casting shell formed later around the cluster. The central wax sprue defines the locations and configurations of runner channels and gates for routing molten metal, introduced into the sprue, to the mold cavities in the casting shell. The runner channels can include one or more filters (made, e.g., of ceramic) for enhancing smooth laminar flow of molten metal into and in the casting shell and for preventing entry of any dross, that may be trapped in the mold, into the shell cavities.

The casting shell is constructed by immersing the casting cluster into a liquid ceramic slurry, followed by immersion in a bed of refractory particles. This immersion sequence is repeated as required to build up a sufficient wall thickness of ceramic material around the casting cluster, thereby forming an investment-casting shell. An exemplary immersion sequence includes six dips of the casting cluster in liquid ceramic slurry and five dips in the bed of refractory particles, yielding an investment-casting shell comprising alternating layers of ceramic slurry and refractory material. The first two layers of refractory material desirably comprise fine (300 mesh) zirconium oxide particles, and the third to fifth layers of refractory material can comprise coarser (200 mesh to 35 mesh) aluminum oxide particles. Each layer is dried under controlled temperature (25±5° C.) and relative humidity (50±5%) before applying the subsequent layer.

The investment-casting shell is placed in a sealed steam autoclave in which the pressure is rapidly increased to 7-10 $kgf/cm^2$. Under such a condition, the wax in the shell is melted out using injected steam. The shell is then baked in an oven in which the temperature is ramped up to 1000-1300° C. to remove residual wax and to increase the strength of the shell. The shell is now ready for use in investment casting.

After the club-head is designed and the initial pattern is made, the manufacturing effort is shifted to a metal caster. To make the investment-casting shell, the metal caster first configures the cluster comprising multiple initial patterns for individual club-heads. Configuring the cluster also involves configuring the metal-delivery system (gates and runners for later delivery of molten metal). After completing these tasks, the caster tools up to fabricate the casting shells.

Figure 12:
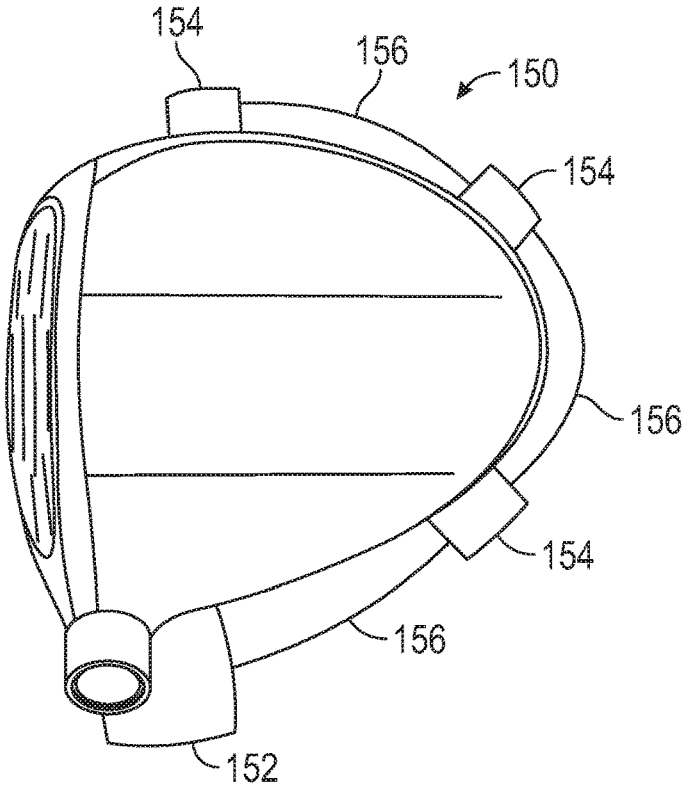
FIG. 12 is a top view of an exemplary initial pattern for a wood-type club head, showing a main gate, assistant gates, and flow channels.

An important aspect of configuring the cluster is determining the locations at which to place the gates. A mold cavity for an individual club-head usually has one main gate, through which molten metal flows into the mold cavity. Additional auxiliary ("assistant") gates can be connected to the main gate by flow channels. During investment casting using such a shell, the molten metal flows into each of the mold cavities through the respective main gates, through the flow channels, and through the auxiliary gates. This manner of flow requires that the mold for forming the initial pattern of a club-head also define the main gate and any assistant gates. After molding the wax initial pattern of the club-head, the initial pattern is removed from the mold, and the locations of flow channels are defined by "gluing" (using the same wax) pieces of wax between the gates. Reference is made to FIG. 12, which depicts an initial pattern 150 for a metal-wood clubhead. Shown are the main gate 152 and three assistant gates 154. Flow channels 156 interconnect the assistant gates 154 and main gate 152 to one another.

Multiple initial patterns for respective club-heads are then assembled into the cluster, which includes attaching the individual main gates to "ligaments." The ligaments include the sprue and runners of the cluster. A "receptor," usually made of graphite or the like, is placed at the center of the cluster where it later will be used to receive the molten metal and direct the metal to the runners. The receptor desirably has a "funnel" configuration to aid entry-flow of molten metal. Additional braces (made of, e.g., graphite) may be added to reinforce the cluster structure.

Usually, the overall wax-cluster is sufficiently large (especially if the furnace chamber that will be used for forming the shell is large) to allow pieces of wax to be "glued" to individual branches of the cluster first, followed by ceramic coating of the individual branches separately before the branches are assembled together into the cluster. Then, after assembling together the branches, the cluster is transferred to the shell-casting chamber.

Figure 13:
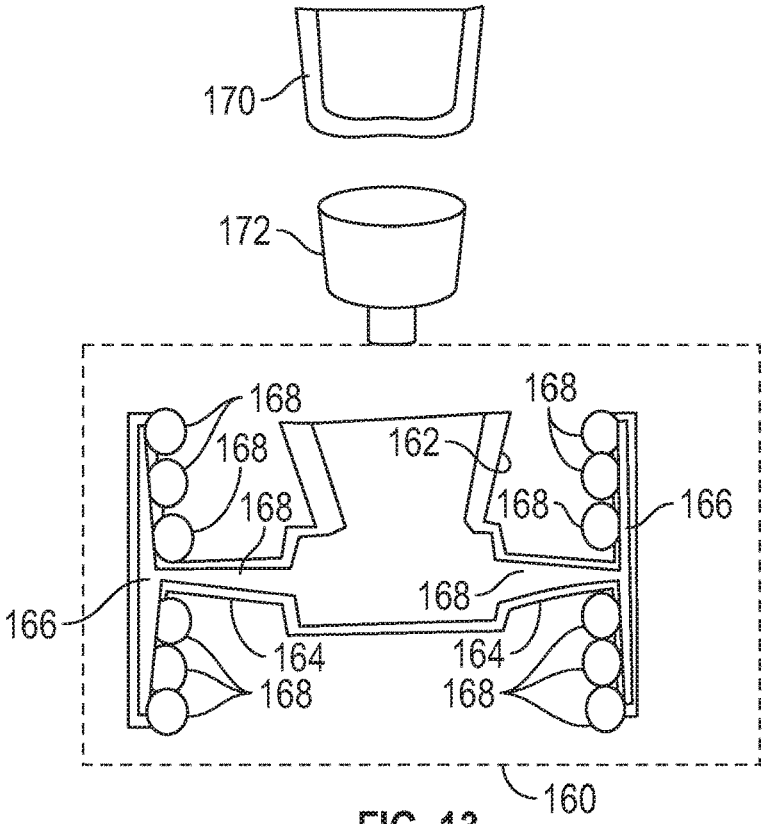
FIG. 13 is a schematic depiction of a casting cluster comprising multiple mold cavities.
Figure 14:
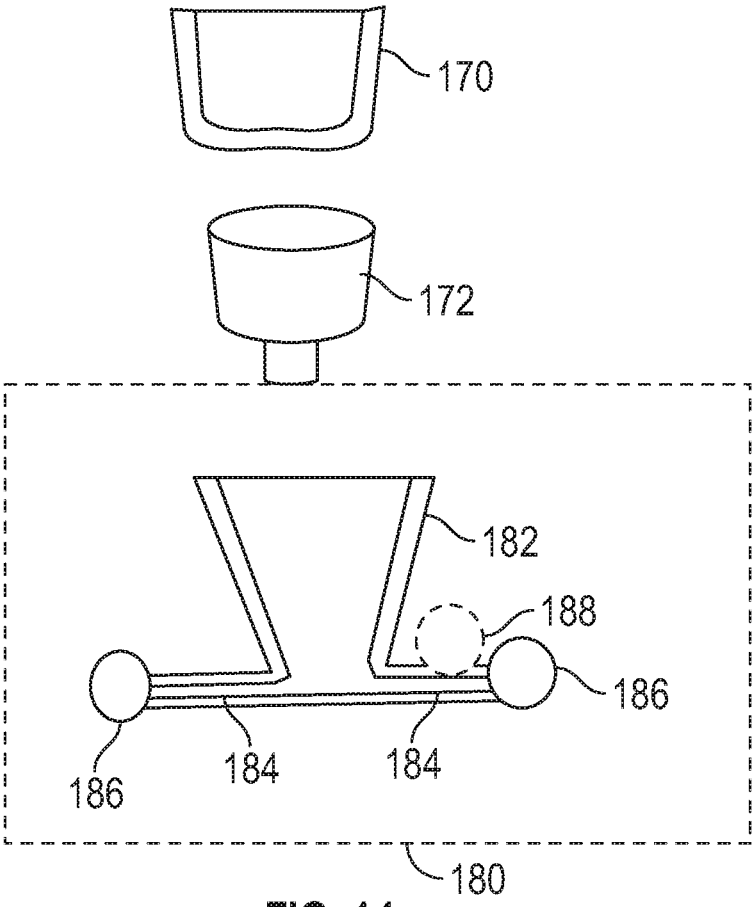
FIG. 14 is a schematic depiction of another casting cluster comprising multiple mold cavities.

Two exemplary clusters are shown in FIGS. 13 and 14, respectively. In FIG. 13, the depicted cluster 160 comprises a graphite receptor 162, a graphite cross-spoke 164, runners 166, and mold cavities 168. Each mold cavity 168 is for a respective club-head. Molten metal in a crucible 170 is poured into the cluster 160 using a pouring cup 172, which directs the molten metal into the receptor 162, into the branches 166, and then into the mold cavities 168. In FIG. 14, the depicted cluster 80 comprises a receptor 182 coupled to shell runners 184. Mold cavities are of two types in this configuration, "straight-feed" cavities 186 and "side feed" cavities 188. Molten metal in a crucible 170 is poured into the cluster 180 using a pouring cup 172, which directs the molten metal into the receptor 182, into the shell runners 184, and then into the mold cavities 186, 188.

The reinforced wax cluster is then coated with multiple layers of slurry and ceramic powders, with drying being performed between coats. After forming all the layers, the resulting investment-casting shell is autoclaved to melt the wax inside it (the ceramic and graphite portions are not melted). After removing the wax from the shell, the shell is sintered (fired), which substantially increases its mechanical strength. If the shell will be used in a relatively small metalcasting furnace (e.g., capable of holding a cluster of only one branch), the shell can now be used for investment casting. If the shell will be used in a relatively large metal-casting furnace, the shell can be assembled with other shell branches to form a large, multi-branched cluster.

Modern investment casting of metal alloys is usually performed while rotating the casting shell in a centrifugal manner to harness and exploit the force generated by the $\omega^2 r$ acceleration of the shell undergoing such motion, where $\omega$ is the angular velocity of the shell and r is the radius of the angular motion. This rotation is performed using a turntable situated inside a casting chamber under a sub atmospheric pressure. The force generated by the $\omega^2 r$ acceleration of the shell urges flow of the molten metal into the mold cavities without leaving voids. The investment-casting shell (including its constituent clusters and runners) is generally assembled outside the casting chamber and heated to a pre-set temperature before being placed as an integral unit on the turntable in the chamber. After mounting the shell to the turntable, the casting chamber is sealed and evacuated to a pre-set sub atmospheric-pressure ("vacuum") level. As the chamber is being evacuated, the molten alloy for casting is prepared, and the turntable commences rotating. When the molten metal is ready for pouring into the shell, the casting chamber is at the proper vacuum level, the casting shell is at a suitable temperature, and the turntable is spinning at the desired angular velocity. Thus, the molten metal is poured into the receptor of the casting shell and flows throughout the shell to fill the mold cavities in the shell.

As molten metal flows into the shell cavity and makes contact with the cavity surface, the high temperature environment (from both the molten metal and the preheated shell) encourages diffusion of elements, such as oxygen, in the shell material. Although titanium casting is always carried out under the sub atmospheric-pressure (vacuum) and oxygen is not available in the ambient environment, oxygen can still be found in the shell (as the shell consists of multiple layers of "oxides"). Introducing oxygen to the molten titanium causes the formation of an oxygen-rich layer, the alpha-case, on the surface of the titanium object to be cast. Typically, the thickness of the alpha-case is on the order of 1-4% of the thickness of the object.

As the alpha-case is "enriched" with oxygen, it is brittle (oxygen is one of the most effective elements of increasing the strength of titanium alloys, but while the strength is increased the ductility is greatly reduced) and can easily crack upon loading. To reduce the propensity of forming alpha-case the diffusion rate of oxygen needs to be reduced, and to reduce the diffusion rate the temperature needs to be reduced. However, it is impossible to reduce the temperature of the molten titanium. Therefore, reducing the temperature of the pre-heated shell is one way of reducing the diffusion rate of oxygen, thus reducing the formation of the alpha-case.

Typically, before transferring to the casting furnace a casting shell will be heated (called pre-heating) to aid the flow of molten titanium. The higher the pre-heat temperature of the shell, the easier the flow of titanium. This is essential for thin-wall titanium casting and the pre-heat temperature can be as high as 1100-1200 C. On the other hand, such high temperatures tend to produce thick alpha-case layers (towards the higher end of the 1-4% wall thickness range). Therefore, the pre-heat temperature of a casting shell can be lowered if the formation of alpha-case is a concern. Typically, the pre-heat temperature of a casting shell is lower than 1000 C or, preferably, lower than 900 C for non-flow-critical titanium castings where formation of alpha-case is undesirable.

Cluster Casting Methods

Figure 15:
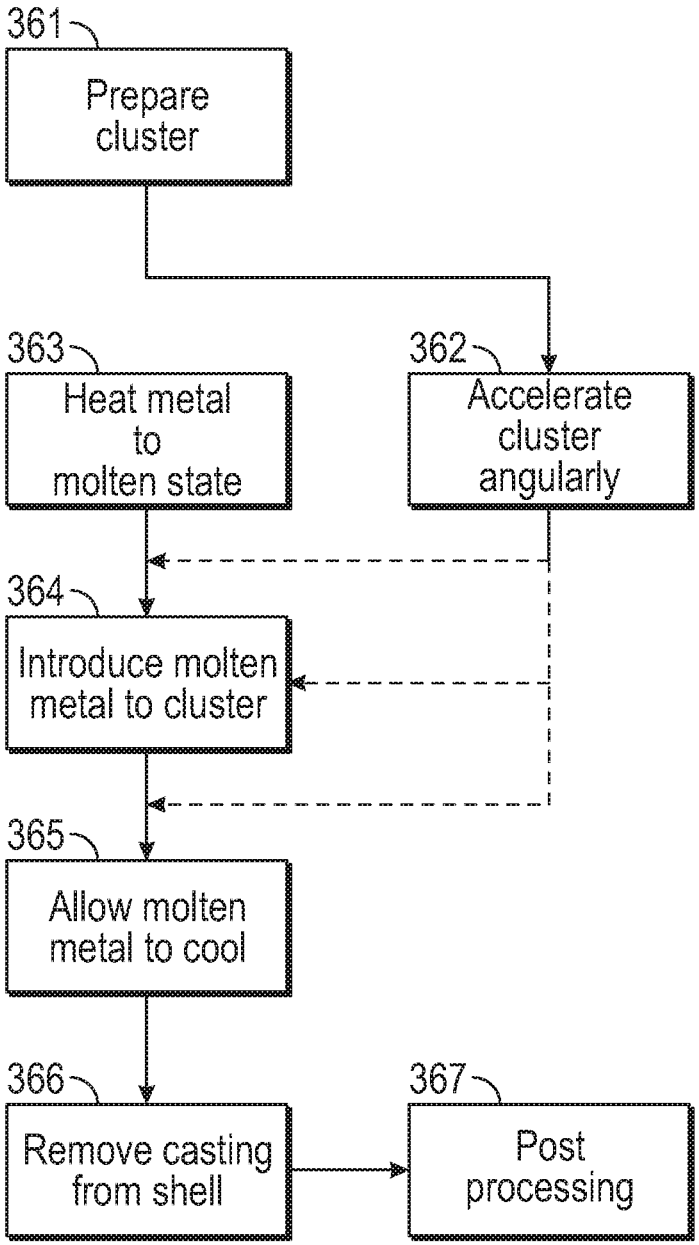
FIG. 15 is a work flow diagram indicating a method for casting golf club heads.

As seen with reference to FIG. 15, a method of manufacturing golf club heads involves preparing a cluster as disclosed elsewhere in this disclosure as shown with reference to step 361. In various embodiments, the step of preparing a cluster may include a preheat step as disclosed elsewhere herein. One aspect of the current disclosure is that cluster preheat may be lower than needed for traditional investment casting techniques. For example, with traditional investment casting techniques, preheat may be on the order of 1000 C-1400 C; with centrifugal casting of the current disclosure, temperatures of preheat may be less than 1,000 C in some embodiments; less than 800 C in some embodiments; or about 500 C or less in some embodiments. In some embodiments, no preheat is needed, and casting may occur with the shell at room temperature. When the cluster is prepared, it may be accelerated angularly in accord with step 362. Metal may be by heated to molten state concurrent with cluster preparation and/or cluster acceleration, or may be an intermediate step. However, metal may be heated to molten state in accord with step 363. Molten metal is introduced to the cluster in accord with step 364. As indicated by the broken line leading from step 362 to step 364, the cluster may be angularly accelerated before, after, or concurrently with the introduction of molten metal to the cluster. Molten metal is allowed to cool in accord with step 365. The cluster casting is removed from the cluster shell in step 366, and post-processing occurs in accord with step 367 and beyond.

In some embodiments, step 363 includes heating metal to molten state. In various embodiments, heating temperatures may be higher or lower depending on application. In some embodiments, step 362 includes accelerating the cluster angularly to an angular velocity, e.g., about 360 revolutions per minute. In various embodiments, angular speeds may range from 250-450 revolutions per minute. In various embodiments, angular speeds as low as 150 rpm and as high as 600 rpm may be suitable.

Because of lower casting temperatures, the step of allowing molten metal to cool in the mold cluster includes a reduced waiting time as compared to traditional investment-casting processes. The result is improved yield and better cycle times. In various traditional investment casting methods that rely on gravity, casting of only 6-8 maximum parts was possible. Using centrifugal casting, 18-25 parts or more may be cast in one cycle, thereby increasing production capacity for a single casting cycle. Additionally, yield per gram of pour is also increased. For traditional investment casting methods, a certain mass of metal is used to cast a certain number golf club heads. With spin casting techniques of the current disclosure, the same mass of metal can be used to produce more golf club heads. Improvements and honing of the techniques in the current disclosure can reduce this mass of metal/per head even further. Reduced cycle times can also be present depending on particular methodology. Additionally, the methods described herein lead to reduced tooling and capital expenditure required for the same production demand. As such, methods described herein reduce cost and improve production quality.

Additionally, casting according to the method described herein leads to a savings in material and achieve greater throughput because material can be more easily flowed to a greater number of heads given the increased acceleration and, thereby, force applied to the casting. Finally, alloys that typically are manufactured using other methods may be more easily cast to similar geometries.

Gating and Cluster Configurations

Configuring the gates and the cluster(s) involves consideration of multiple factors. These include (but are not necessarily limited to): (a) the dimensional limitations of the casting chamber of the metal-casting furnace, (b) handling requirements, particularly during the slurry-dipping steps that form the investment-casting shell, (c) achieving an optimal flow pattern of the molten metal in the investment-casting shell, (d) providing the cluster(s) of the investment-casting shell with at least minimum strength required for them to withstand rotational motion during metal casting, (e) achieving a balance of minimum resistance to flow of molten metal into the mold cavities (by providing the runners with sufficiently large cross-sections) versus achieving minimum waste of metal (e.g., by providing the runners with small cross-sections), and (f) achieving a mechanical balance of the cluster(s) about a central axis of the casting shell. Item (e) can be important because, after casting, any metal remaining in the runners does not form product but rather may be "contaminated" (a portion of which is usually recycled). These configurational factors are coupled with metal-casting parameters such as shell-preheat temperature and time, vacuum level in the metal-casting chamber, and the angular velocity of the turntable to produce actual casting results. As club-head walls are made increasingly thinner, careful selection and balance of these parameters are essential to produce adequate investment-casting results.

Details of investment casting as performed at metal casters tend to be proprietary. But, experiments at various titanium casters have in the past revealed some consistencies and some general trends. For example, a particular club-head (having a volume of 460 $cm^3$, a crown thickness of 0.6 mm, and a sole thickness of 0.8 mm) was fabricated at each of six titanium casters (having respective metal-casting furnaces ranging from 10 kg to 80 kg capacity), producing the data tabulated in FIGS. 16 and 17. The parameters listed in FIGS. 16 and 17 include the following:

"R max" is the maximum radius of the cluster

"R min" is the minimum radius of the cluster

"Wet perimeter" is the total perimeter of the runner

"R (flow radius)" is the cross-sectional area/wet perimeter of the runner

"Sharp turn" is a 90-degree or greater turn in the runner system

"Process loss ratio" is the ratio of process loss to pouring material

"Velocity max" is the velocity at the maximum radius

"Velocity min" is the velocity at the minimum radius

"Acceleration max" is the acceleration at the maximum radius

"Acceleration min" is the acceleration at the minimum radius

"Force max" is the force at the maximum radius (note that this is an approximation of the magnitude of force being applied to the molten metal at a gate. Due to each particular cluster design, the true force is almost always lower than the calculated value, with more complex clusters exhibiting greater reduction of the force.)

"Force min" is the force at the minimum radius (note that this is an approximation of the magnitude of force being applied to the molten metal at the gate. Due to each particular cluster design, the true force is almost always lower than the calculated value, with more complex clusters exhibiting greater reduction of the force.)

"Pressure max" is the pressure of molten metal in the runner at maximum radius (=Force max/Runner cross-sectional area)

"Pressure min" is the pressure of molten metal in the runner at minimum radius (=Force min/Runner cross-sectional area)

"Kinetic energy max" is the kinetic energy of molten metal at the maximum radius "Density" is the density of molten metal (titanium alloy) at the melting point of 1650 C.

"Viscosity" is the viscosity of molten titanium at 1650 C

"Re number max" is the Reynolds number for pipe flow at maximum radius

"Re number min" is defined consistently as Re number max, but at a minimum radius.

Minimum Force Requirement

FIGS. 16 and 17 provide a table of data that indicates that at least a minimum force (and thus at least a minimum pressure) should be applied to the molten metal entering the casting shell for each cluster to achieve a good casting yield. The force applied to the molten metal is generated in part by the mass of actual molten metal entering the mold cavities in the cluster and by the centrifugal force produced by the rotating turntable of the casting furnace. A reduced minimum force is desirable because a lower force generally allows a reduction in the amount, per club-head, of molten metal necessary for casting. However, other factors tend to indicate increasing this force, including: thinner wall sections in the item being cast, more complex clusters (and thus more complex flow patterns of the molten metal), reduced shell-preheat temperatures (resulting in a greater loss of thermal energy from the molten metal as it flows into the investment-casting shell), and substandard shell qualities such as rough mold-cavity walls and the like. The data in FIGS. 16 and 17 indicate that the minimum force required for casting a titanium-alloy club-head, of which at least a portion of the wall is 0.6 mm thick, is approximately 160 Nt. Caster 1 achieved this minimum force.

From the minimum-force requirement can be derived a lower threshold of the amount of molten metal necessary for pouring into the shell. Excluding unavoidable pouring losses, the best metal usage (as achieved by caster 1) was 386 g (0.386 kg) for club-heads each having a mass of approximately 200 g (including gate and some runner). This is equivalent to a material-usage ratio of 200/386=52 percent. The accelerations (max) applied to the investment-casting shell by the casters 2-6 were all higher than the acceleration applied by caster 1, but more molten metal was needed by each of casters 2-6 to produce respective casting yields that were equivalent to that achieved by caster 1.

Figure 18:
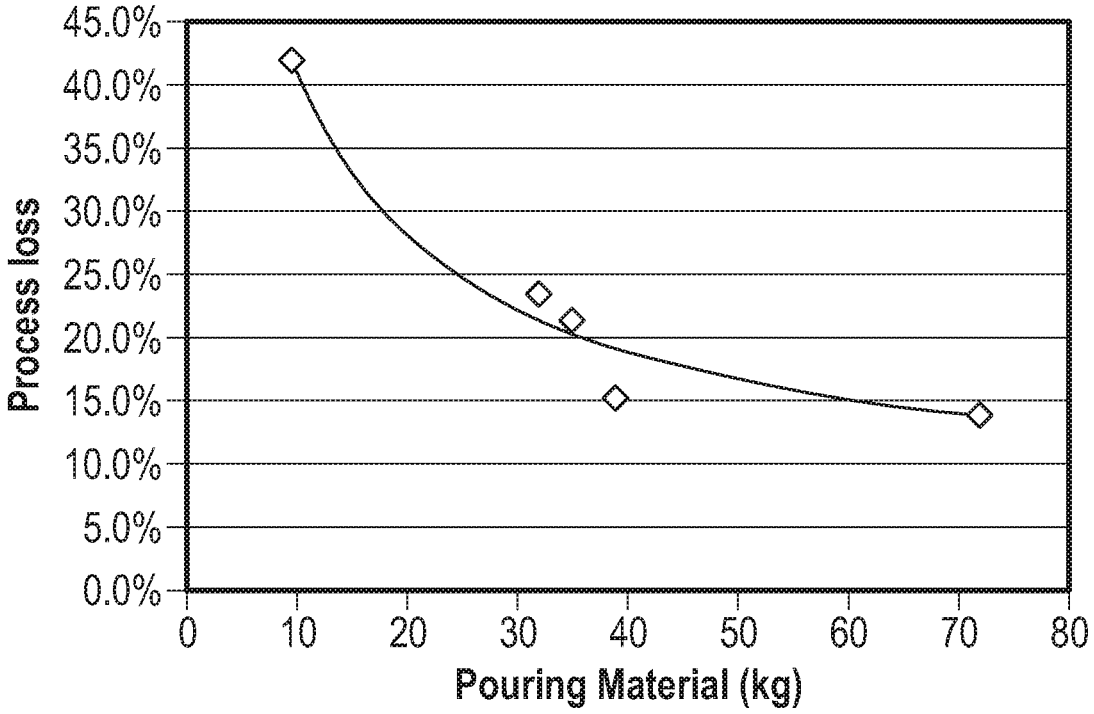
FIG. 18 is a plot of process loss versus mass of pouring material (molten metal), for titanium alloy the latter being indicative of casting-furnace size for the various casters.

Some process loss (splashing, cooled metal adhering to side walls of the crucible and coup supplying the liquid titanium alloy, revert cleaning loss, and the like) is unavoidable. Process loss imposes an upper limit to the efficiency that can be achieved by smaller casting furnaces. i.e., the percentage of process loss increases rapidly with decreases in furnace size, as illustrated in FIG. 18.

On the other hand, smaller casting furnaces advantageously have simpler operation and maintenance requirements. Other advantages of smaller furnaces are: (a) they tend to process smaller and simpler clusters of mold cavities, (b) smaller clusters tend to have separate respective runners feeding each mold cavity, which provides better interface-gating ratios for entry of molten metal into the mold cavities, (c) the furnaces are more easily and more rapidly preheated prior to casting, (d) the furnaces offer a potentially higher achievable shell-preheat temperature, and (e) smaller clusters tend to have shorter runners, which have lower Reynolds numbers and thus pose reduced potentials for disruptive turbulent flow. While larger casting furnaces tend not to have these advantages, smaller casting furnaces tend to have more unavoidable process loss of molten metal per mold cavity than do larger furnaces.

In view of the above, the cost-effective casting systems (furnaces, clusters, yields, net material costs) appear to include medium-sized systems, so long as appropriate cluster- and gate-design considerations are incorporated into configurations of the investment-casting shells used in such furnaces. This can be seen from comparing casters 1, 4, and 5. The overall usages of material (without considering process losses) by these three casters are very close (664-667 g/cavity). Material usage (considering process loss) by caster 1 is 386 g, while that of casters 4 and 5 is 510 g. Thus, whereas casters 4 and 5 could still improve, it appears that caster 1 has reached its limit in this regard.

Flow-Field Considerations

At least the minimum threshold force applied to molten metal entering the investment-casting shell can be achieved by either changing the mass or increasing the velocity of the molten metal entering the shell, typically by decreasing one and increasing the other. There is a realistic limit to the degree to which the mass of "pour material" (molten metal) can be reduced. As the mass of pour material is reduced, correspondingly more acceleration is necessary to generate sufficient force to move the molten metal effectively into the investment-casting shell. But, increasing the acceleration increases the probability of creating turbulent flow of the molten metal entering the shell. Turbulent flow is undesirable because it disrupts the flow pattern of the molten metal. A disrupted flow pattern can require even greater force to "push" the metal though the main gate into the mold cavities.

The Reynolds number can be easily modified by changing the shape and/or dimensions of the runner(s). For example, changing R (flow radius) will affect the Reynolds number directly. The smaller R (flow radius) will result in less minimum force (the two almost having a reciprocal relationship). Hence, an advantageous consideration is first to reduce the Reynolds number to maintain a steady flow field of the molten metal, and then satisfy the requirement of minimum force by adjusting the amount of pour material.

Other Factors

One additional factors is preheating the investment-casting shell before introducing the molten metal to it. Caster 1 achieved 94% yield with the smallest Reynolds number and the minimum amount of pour material (and thus the lowest force) in part because caster 1 had the highest shell-preheat temperature. Another factor is the complexity of the cluster(s). Evaluating a complex cluster is very difficult, and the high Reynolds numbers usually exhibited by such clusters are not the only variable to be controlled to reduce disruptive turbulent flow of molten metal in such clusters. For example, the number of "sharp" turns (90-degree turns or greater) in runners and mold cavities of the cluster is also a factor. In regard to FIGS. 16 and 17, the investment-casting shell used by caster 1 has one sharp turn (and another less-sharp turn), whereas the shell used by caster 6 has three sharp turns. It is possible that caster 6 needs to rotate its shell at a higher angular velocity just to overcome the flow resistance posed by these sharp turns. But, this would not alleviate disrupted flow patterns posed by the sharp turns. Hence, investment-casting shells comprising simpler cluster(s) (with fewer sharp turns to allow more "natural" flow routes of molten metal) are desired.

Another factor is matching the runner and gates. The interface gating ratio for caster 1 is the closest to 100% (indicating optimal gating), compared to the substantially inferior data from the other casters. The "worst" was caster 3, whose investment-casting shell had a Reynolds number almost as low as that of caster 1, but caster 3 achieved a yield of only 78%, due to a poor interface gating ratio (approximately 23%). The low interface gating ratio exhibited by the shell of caster 3 increased the difficulty of determining whether the cause of caster 3's low yield was insufficient pour material to fill the gates or the occurrence of "two-phase flow-liquid and vacancy." In any event, the overall cross-sectional areas of runners and gates may be kept as nearly equal (and constant) to each other as possible to achieve constant flow velocity of liquid metal throughout the shell at any moment during pouring. For thin-walled titanium alloy castings, this principle applies especially to the interfaces between the runner and the main gates, where the interface gating ratio should be no less than unity (1.0).

Yet another factor is the cross-sectional shape of the runner. Comparing casters 4 and 5, and casters 2 and 5, triangular-section runners appeared to produce lower Reynolds numbers than rounded or rectangular runners. Although using triangular-section runners can cause problems with interface gating ratio (as metal flows from such a runner into a rectilinear-section or round-section gate), the significant reduction in Reynolds numbers achieved using triangular-section runners is worth pursuing as the difference in pour material used by casters 2 and 5 indicates (39 kg versus 32 kg).

Figure 19:
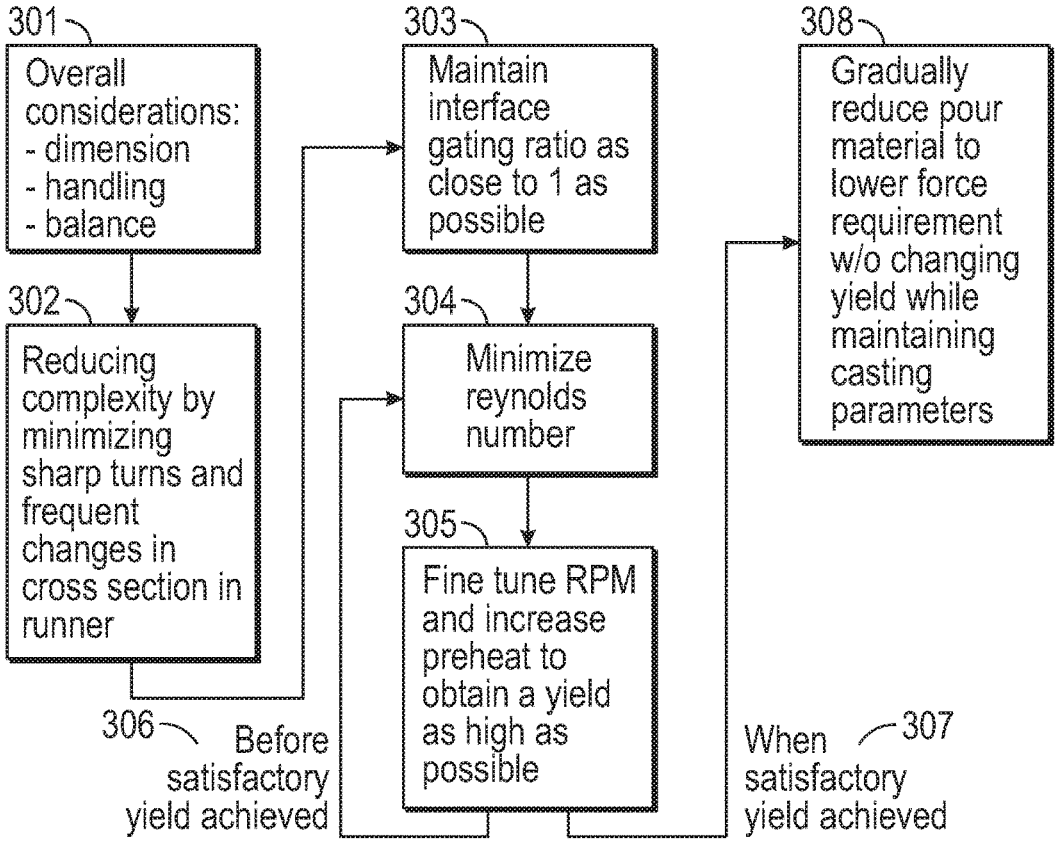
FIG. 19 is a flow chart of an embodiment of a method for configuring a casting cluster.

A flow-chart for configuring a cluster of an investment-casting shell is shown in FIG. 19. In a first step 301, overall considerations of the intended cluster are made such as dimensions, handling, and balance. Next, the complexity of the cluster is reduced by minimizing sharp turns and any unnecessary (certainly any frequent) changes in runner cross-section (step 302). The interface gating ratio is maintained as close as possible to unity (step 303). Also, the Reynolds number is minimized as much as practicable (step 304). The angular velocity (RPM) of the turntable is fine-tuned and the shell pre-heat temperature is increased to produce the highest possible product yield (step 305). Iteration (306) of steps 304, 305 is usually required to achieve a satisfactory yield. In step 308, after a satisfactory yield is achieved (307), the mass of pour material (molten metal) is gradually reduced to reduce the force required to urge flow of molten metal throughout the cluster, but without decreasing product yield and while maintaining other casting parameters.

More information regarding investment casting methods and devices for casting thin-walled club heads using titanium alloys and other materials can be found in U.S. Pat. No. 7,513,296, issued Apr. 7, 2009, and in U.S. Publication No. 2016/0175666, published Jun. 23, 2016, both of which are incorporated by reference herein in their entireties. While these incorporated references disclose methods and systems for casting club head bodies without the face plate included (face plate is later attached to body), the same or similar methods and systems can be used, with the same or similar benefits and advantages, to cast the herein disclosed club head bodies where the face in an integrally cast part of the body, not formed separately and later attached to the body.

More information regarding coatings on molds for casting titanium alloys, and methods for producing molds having a calcium oxide face coat for use in casting titanium alloys, can be found in U.S. Pat. No. 5,766,329, issued Jun. 16, 1998, which is incorporated by reference herein in its entirety.

Club Heads Comprising Cast Titanium Alloy Body/Face

Compared to titanium golf club faces formed for sheet machining or forging processes, cast faces can have the advantage of lower cost and complete freedom of design. However, golf club faces cast from conventional titanium alloys, such as 6-4 Ti, need to be chemically etched to remove the alpha case on one or both sides so that the faces are durable. Such etching requires application of hydrofluoric (HF) acid, a chemical etchant that is difficult to handle, extremely harmful to humans and other materials, an environmental contaminant, and expensive.

Faces cast from titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys.

Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club heads that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast 9-1-1 Ti face and body unit, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

In some cases, the reduced thickness of the alpha case for 9-1-1 Ti face plates (e.g., 0.15 mm or less) may not be thin enough to provide sufficient durability needed for a face plate and to avoid needing to etch away some of the alpha case with a harsh chemical etchant, such as HF acid. In such cases, the pre-heat temperature of the mold can be lowered (such as to less than 800 C, less than 700 C, less than 600 C, and/or less than or equal to 500 C) prior to pouring the molten titanium alloy into the mold. This can further reduce the amount of oxygen transferred from the mold to the cast titanium alloy, resulting in a thinner alpha case (e.g., less than 0.15 mm, less than 0.10 mm, and/or less than 0.07 mm).

This provides better ductility and durability for the cast body/face unit, which is especially important for the face plate.

The thinner alpha case in cast 9-1-1 Ti faces helps provide enhanced durability, such that the face is durable enough that the removal of part of the alpha case from the face via chemical etching is not needed. Thus, hydrofluoric acid etching can be eliminated from the manufacturing process when the body and face are unitarily cast using 9-1-1 Ti, especially when using molds with lower pre-heat temperatures. This can simplify the manufacturing process, reduce cost, reduce safety risks and operation hazards, and eliminate the possibility of environmental contamination by HF acid. Further, because HF acid is not introduced to the metal, the body/face, or even the whole club head, can comprise very little or substantially no fluorine atoms, which can be defined as less than 1000 ppm, less than 500 ppm, less than 200 ppm, and or less than 100 ppm, wherein the fluorine atoms present are due to impurities in the metal material used to cast the body.

Variable Face Thickness and Bulge & Roll Properties of Faces

In certain embodiments, a variable thickness face profile may be implemented on the face plate, for example as is described in U.S. patent application Ser. No. 12/006,060 and U.S. Pat. Nos. 6,997,820; 6,800,038; 6,824,475; 7,731,603; and 8,801,541; the entire contents of each of which are incorporated herein by reference. Varying the thickness of a face plate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for re-allocation to another area of the club head. For example, as shown in FIG. 9 face plate 18 has a thickness t defined between the exterior surface 22 and the interior surface 40 facing the interior cavity of the golf club head. The face plate 18 can include a central portion 42 positioned adjacent the ideal impact location 23 on the external surface 22. The central portion 42 can have thickness that is similar to the thickness at the perimeter of the face plate, or slightly greater or less. The face plate 18 also can include a diverging portion 44 extending radially outward from the central portion 42, which may be elliptical. The interior surface 40 may be symmetrical about one or more axes and/or may be unsymmetrical about one or more axes. The thickness t of the diverging portion 44 increases in a direction radially outward from the central portion 42. The face plate 18 includes a converging portion 46 extending from the diverging portion 44 via a transition portion 48. The thickness t of the converging portion 46 substantially decreases with radially outward position from the transition portion 48. In certain instances, the transition portion 48 is an apex between the diverging and converging portions 44, 46. In other implementations, the transition portion 48 extends radially outward from the diverging portion 44 and has a substantially constant thickness t (see FIGS. 7-9).

Figure 7:
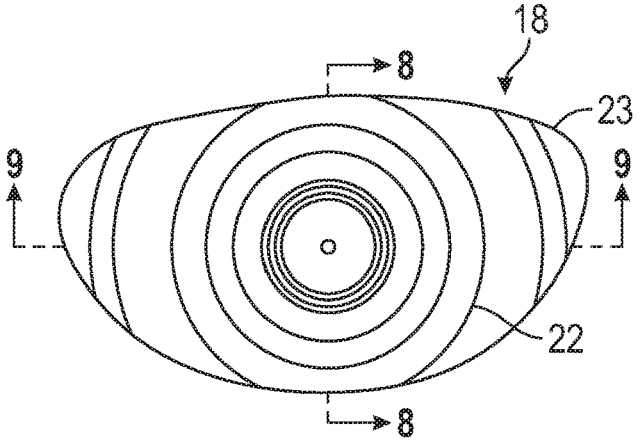
FIG. 7 is a rear elevation view of an exemplary face plate having variable thickness.
Figure 8:
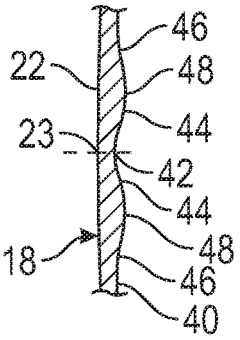
FIG. 8 is a cross-sectional side view of the face plate of FIG. 7 taken along the line 8-8 of FIG. 7.
Figure 9:
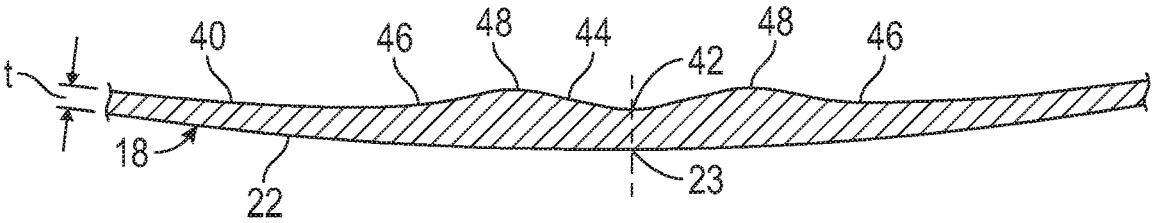
FIG. 9 is a cross-sectional side view of the face plate of FIG. 7 taken along the line 9-9 of FIG. 7.

In some embodiments, the cross-sectional profile of the face plate 18 along any axes extending perpendicular to the face plate at the ideal impact location 23 is substantially similar as in FIGS. 7-9. In other embodiments, the cross-sectional profile can vary, e.g., is non-symmetric. For example, in certain implementations, the cross-sectional profile of the face plate 18 along the head origin z-axis might include central, transition; diverging and converging portions as described above (see FIGS. 7-9). However, the cross-sectional profile of the face plate 18 along the head origin x-axis can include a second diverging portion extending radially from the converging portion 46 and coupled to the converging portion via a transition portion. In alternative embodiments, the cross-sectional profile of the face plate 18 along the head origin z-axis can include a second diverging portion extending radially from the converging portion and coupled to the converging portion, as described above with regard to variation along the head origin x-axis.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm. The face thickness should have a thickness change of at least 25% over the face (thickest portion compared to thinnest) in order to save weight and achieve a higher ball speed on off-center hits.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

Figure 10:
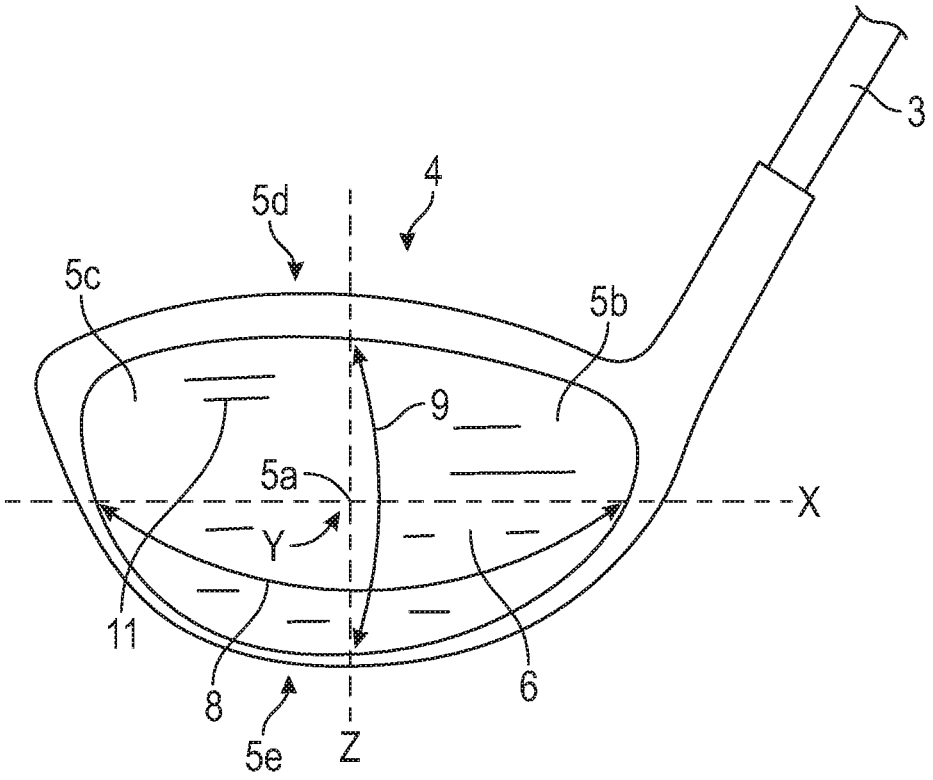
FIG. 10 is a front elevation view of the golf club heads of the present invention showing the bulge and roll measurement system.
Figure 11:
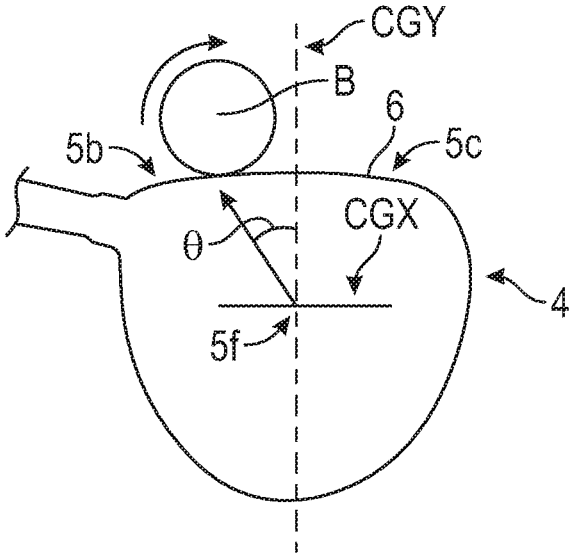
FIG. 11 is an illustration of the golf club head striking a golf ball on the heelward side of the golf club head.

FIGS. 10 and 11 show a golf club head 4 with a shaft 3. The club head 4 includes a center face 5*a*, a heel 5*b*, a toe 5*c*, a crown 5*d*, and a sole 5*e*. The club head 4 further comprises a club face 6 including a curvature from the heel 5*b* to the toe 5*c* commonly called a bulge 8. The club face 6 also includes a curvature from the crown 5*d* to the sole 5*e* commonly called a roll 9. In at least one embodiment, the combination of curvatures may provide a club face 6 with a substantially toroidal shape, or a shape similar to a section of a toroid. The club face 6 further includes an X-axis X which extends horizontally through the center face 5*a* from the heel 5*b* to the toe 5*c*, a Z-axis Z which extends vertically through the center face 5*a* from the crown 5*d* to the sole 5*e*, and a Y-axis Y which extends horizontally through the center face and into the page in FIG. 10. The X-axis X, Y-axis Y, and Z-axis Z are mutually orthogonal to one another.

As shown in FIG. 11, the club head 4 additionally has a center of gravity (CG) 5*f* which is internal to the club head. The club head 4 has a CG X-axis, a CG Y-axis, and a CG Z-axis which are mutually orthogonal to one another and pass through the CG 5*f* to define a CG coordinate system. The CG X-axis and CG Y-axis lie in a horizontal plane parallel to a flat ground surface. The CG Z-axis lies in a vertical plane orthogonal to a flat ground surface. In one embodiment the CG Y-axis may coincide with the Y-axis Y, but in most embodiments the axes do not coincide.

FIG. 11 is an exaggerated depiction of the club head 4 striking a golf ball B on the heel 5*b* of the club head. This imparts a clockwise spin to the golf ball B which causes the golf ball to curve to the right during flight. As discussed above, striking the golf ball B on the heel 5*b* of the club head 4 will cause the golf ball to leave the club head 4 at an angle Θ relative to the CG Y-axis of the club head 4. It will be understood that the angle Θ merely depicts a general angle at which the ball will leave the club head and is not intended to depict or imply the actual angle relative to the centerline, or the point from which that angle would be measured. Angle Θ further illustrates that a ball struck on the heel of the club will initially travel on a flight path to the left of the centerline.

The method used to obtain the values in the present disclosure is the optical comparator method. Referring back to FIG. 10, the club face 6 includes a series of score lines 11 which traverse the width of the club face generally along the X-axis X of the club head 4. In the optical comparator method, the club head 4 is mounted face down and generally horizontal on a V-block mounted on an optical comparator. The club head 4 is oriented such that the score lines 11 are generally parallel with the X-axis of the optical comparator. More precise orientation steps may also be used. Measurements are then taken at the geometric center point 5*a* on the club face. Further measurements are then taken 20 millimeters away from the geometric center point 5*a* of the club face 6 on either side of the geometric center point 5*a* and along the X-axis X of the club head, and 30 millimeters away from the geometric center point of the club face on either side of the center point and along the X-axis X of the club head. An arc is fit through these five measure points, for example by using the radius function on the machine. This arc corresponds to the circumference of a circle with a given radius. This measurement of radius is what is meant by the bulge radius.

To measure the roll, the club head 4 is rotated by 90 degrees such that the Z-axis Z of the club head is generally parallel to the X-axis of the machine. Measurements are taken at the geometric center point 5*a* of the club face. Further measurements are then taken 15 millimeters away from the geometric center point 5*a* and along the Z-axis Z of the club face 6 on either side of the center point 5*a*, and 20 millimeters away from the geometric center point and along the Z-axis of the club face on either side of the center point. An arc is fit through these five measurement points. This arc corresponds to the circumference of a circle with a given radius. This measurement of radius is what is meant by the roll radius.

Curvature is defined as 1/R wherein R is the radius of the circle which corresponds to the measurement arc of the bulge or the roll. As an example, a bulge with a curvature of 0.020 $cm^{-1}$ corresponds to a bulge measured by a bulge measurement arc which is part of a circle with a radius of 50 cm. A roll with a curvature of 0.050 $cm^{-1}$ corresponds to a roll measured by a roll measurement arc which is part of a circle with a radius of 20 cm.

In some embodiments, the face plates of the disclosed club heads can have the following properties:

i) the roll curvature is between about 0.033 $cm^{-1}$ and about 0.066 $cm^{-1}$, and the bulge curvature is greater than 0 $cm^{-1}$ and less than about 0.027 $cm^{-1}$; and ii) the inverse of the bulge curvature is greater than the inverse of the roll curvature by at least 7.62 cm; and/or iii) the ratio of the bulge curvature divided by the roll curvature, Ro is greater than about 0.28 and less than about 0.75.

Use of vacuum die casting to produce the club heads described herein results in improved quality and reduced scrap. In addition rejections due to high porosity are virtually eliminated as are rejections after any secondary processing. An excellent surface quality is produced while increasing product density and strength are increased and thus making possible larger, thinner, and more complex, castings. From a processing standpoint, less casting pressure is required, and tool life and mold life are extended. Also waste of the metal or alloy due to flash is reduced or eliminated.

By utilizing a vacuum die casting process, it has been surprisingly found that the titanium bodies and face plates of the disclosed club heads exhibit much smaller grain size than is typically observed for analogous titanium objects made by investment casting, with grains of about 100 μm (micrometers) in size versus about 750 μm grain size for investment cast titanium face plates. More specifically, the titanium bodies/face plates disclosed herein can have a grain size of less than about 400 μm, preferably less than about 300 μm, more preferably less than about 200 μm and even more preferably less than about 150 μm, and most preferably less than about 120 μm.

The titanium bodies/face plates disclosed herein can also exhibit much lower porosity than is typically observed for an analogous separately formed titanium face plate made by investment casting. More specifically, the titanium face plates disclosed herein can have a porosity of less than 1% preferably less than 0.5% more preferably less than 0.1%.

The titanium bodies/face plates disclosed herein can also exhibit much higher yield strength, as measured by ASTM E8, than is typically observed for an analogous titanium face plate made by investment casting.

The titanium face plates disclosed here can also exhibit similar fracture toughness to that typically observed for an analogous titanium face plates made by investment casting, and higher than an analogous face plate made from a wrought mill-annealed product.

The titanium face plates disclosed herein can also exhibit ductility as measured by the percent elongation reported in a tensile test which is defined as the maximum elongation of the gage length divided by the original gage length of from about 10% to about 15%.

The titanium face plates disclosed herein can also exhibit a Young's Modulus of 100 GPa+/−10%, preferably +/−5% and more preferably +/−2% as measured by ASTM E-111.

The titanium face plates disclosed herein can also exhibit a Ultimate Tensile Strength of 970 MPa+/−10%, preferably +/−5% and more preferably +/−2% as measured by ASTM E8.

Combination of the various properties described above allows fabrication of metalwood titanium club heads having titanium face plates that can be 10% thinner than the analogous face plates made by conventional investment casting while maintaining as good if not better strength properties.

In addition to the strength properties of the golf club heads of the present invention, in certain embodiments, the shape and dimensions of the golf club head may be formed so as to produce an aerodynamic shape as according to U.S. Patent Publication No. 2013/0123040 A1, filed on Dec. 18, 2012 to Willett et al., the entire contents of which are incorporated by reference herein. The aerodynamics of golf club heads are also discussed in detail in U.S. Pat. Nos. 8,777,773; 8,088,021; 8,540,586; 8,858,359; 8,597,137; 8,771,101; 8,083,609; 8,550,936; 8,602,909; and 8,734,269; the teachings of which are incorporated by reference herein in their entirety.

In addition to the strength properties of the aft body, and the aerodynamic properties of the club head, another set of properties of the club head which must be controlled are the acoustical properties or the sound that a golf club head emits when it strikes a golf ball. At club head/golf ball impact, a club striking face is deformed so that vibrational modes of the club head associated with the club crown, sole, or striking face are excited. The geometry of most golf clubs is complex, consisting of surfaces having a variety of curvatures, thicknesses, and materials, and precise calculation of club head modes may be difficult. Club head modes can be calculated using computer-aided simulation tools. For the club heads of the present invention the acoustic signal produced with ball/club impact can be evaluated as described in in copending U.S. application Ser. No. 13/842,011 filed on Mar. 15, 2013, the entire contents of which are incorporated by reference herein.

In certain embodiments of the present invention the golf club head may be attached to the shaft via a removable head-shaft connection assembly as described in more detail in U.S. Pat. No. 8,303,431 issued on Nov. 6, 2012, the entire contents of which are incorporated by reference herein. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. No. 8,025,587 issuing on Sep. 27, 2011, U.S. Pat. No. 8,235,831 issued on Aug. 7, 2012, U.S. Pat. No. 8,337,319 issued on Dec. 25, 2012, as well as copending US Publication No. 2011/0312437A1 filed on Jun. 22, 2011, US Publication No. 2012/0258818 A1 filed on Jun. 20, 2012, US Publication No. 2012/0122601A1 filed on Dec. 29, 2011, US Publication No. 2012/0071264 A1 filed on Mar. 22, 2011 as well as copending U.S. application Ser. No. 13/686,677 filed on Nov. 27, 2012, the entire contents of which patents, publications and applications are incorporated in their entirety by reference herein.

In certain embodiments the golf club head may feature an adjustable mechanism provided on the sole portion to "decouple" the relationship between face angle and hosel/shaft loft, to allow for separate adjustment of square loft and face angle of a golf club. For example, some embodiments of the golf club head may include an adjustable sole portion that can be adjusted relative to the club head body to raise and lower the rear end of the club head relative to the ground. Further detail concerning the adjustable sole portion is provided in U.S. Pat. No. 8,337,319 issued on Dec. 25, 2012, U.S. Patent Publication Nos. US2011/0152000 A1 filed on Dec. 23, 2009, US2011/0312437 filed on Jun. 22, 2011, US2012/0122601A1 filed on Dec. 29, 2011 and copending U.S. application Ser. No. 13/686,677 filed on Nov. 27, 2012, the entire contents of each of which are incorporated herein by reference.

In some embodiments movable weights can be adjusted by the manufacturer and/or the user to adjust the position of the center of gravity of the club to give the desired performance characteristics can be used in the golf club head. This feature is described in more detail in the following U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, and 7,410,425, the entire contents of each of which are incorporated by reference in their entirety herein.

According to some embodiments of the golf club heads described herein, the golf club head may also include a slidably repositionable weight positioned in the sole and/or skirt portion of the club head. Among other advantages, a slidably repositionable weight facilitates the ability of the end user of the golf club to adjust the location of the CG of the club head over a range of locations relating to the position of the repositionable weight. Further detail concerning the slidably repositionable weight feature is provided in more detail in U.S. Pat. Nos. 7,775,905 and 8,444,505 and U.S. patent application Ser. No. 13/898,313 filed on May 20, 2013 and U.S. patent application Ser. No. 14/047,880 filed on Oct. 7, 2013, the entire contents of each of which are hereby incorporated by reference herein as well the contents of paragraphs [430] to and FIGS. 93-101 of US Patent Publication No. 2014/0080622 (corresponding to U.S. patent application Ser. No. 13/956,046 filed on Jul. 31, 2013 as well as U.S. Patent Application No. 62/020,972 filed on Jul. 3, 2014 and 62/065,552 filed on Oct. 17, 2014, the contents of each of which are hereby incorporated by reference herein.

According to some embodiments of the golf club heads described herein, the golf club head may also include a coefficient of restitution feature which defines a gap in the body of the club, preferably located on the sole portion and proximate the face. This coefficient of restitution feature is described more fully in U.S. patent application Ser. No. 12/791,025, filed Jun. 1, 2010, and Ser. No. 13/338,197, filed Dec. 27, 2011 and Ser. No. 13/839,727, filed Mar. 15, 2013 (now US Publication No. 2014/0274457A1) and Ser. No. 14/457,883 filed Aug. 12, 2014 and Ser. No. 14/573,701 filed Dec. 17, 2014, the entire contents of each of which are incorporated by reference herein in their entirety.

Additional Exemplary Club Heads

FIGS. 20-36D illustrate another exemplary wood-type golf club head 200, which can include any combination of the features disclosed herein. For example, the club head body 202 and face 270 can be cast as a unitary structure from titanium alloys, as discussed herein. The head 200 includes a raised sole construction (see benefits discussed in US 2018/0185719), and also includes two weight tracks 214, 216 with slidably adjustable weights assemblies 210, 212. The head 200 further comprises both a crown insert 206 and a sole insert 208 (see exploded views in FIGS. 21 and 22), which inserts can be constructed from various lightweight materials having multiple layers of fiber reinforcement arranged in desired orientation patters (see further details in US 2018/0185719).

The head 200 comprises a body 202, an adjustable head-shaft connection assembly 204, the crown insert 206 attached to the upper portion of the body, the sole insert 208 mounted inside the body on top of the lower portion of the body, the front weight assembly 210 slidably mounted in the front weight track 214, and the rear weight assembly 212 slidably mounted in the rear weight track 216. The head 200 includes a front sit pad, or ground contact surface, 226 between the front track 214 and the face 270, and a rear sit pad, or ground contact surface, 224 at the rear of the body to the heel side of the rear track 216, with the rest of the sole elevated above the ground when in the normal address position.

Figure 22:
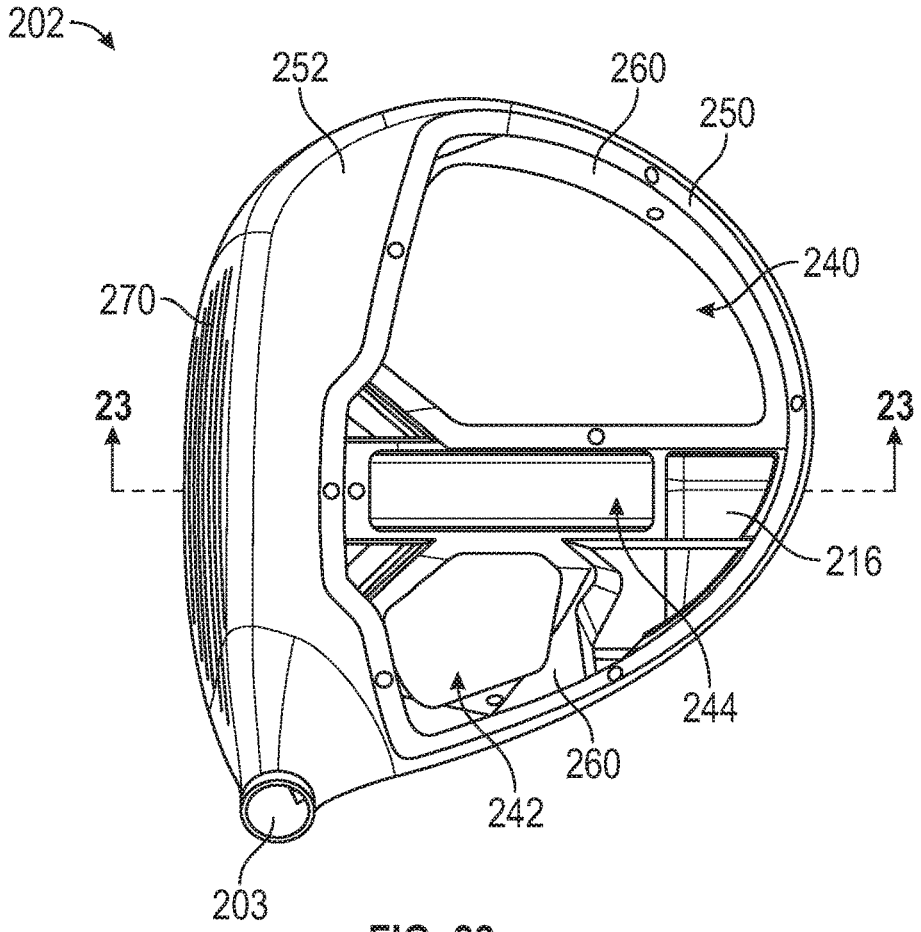
FIG. 22 is a top view of the body of the golf club head of FIG. 20.
Figure 23:
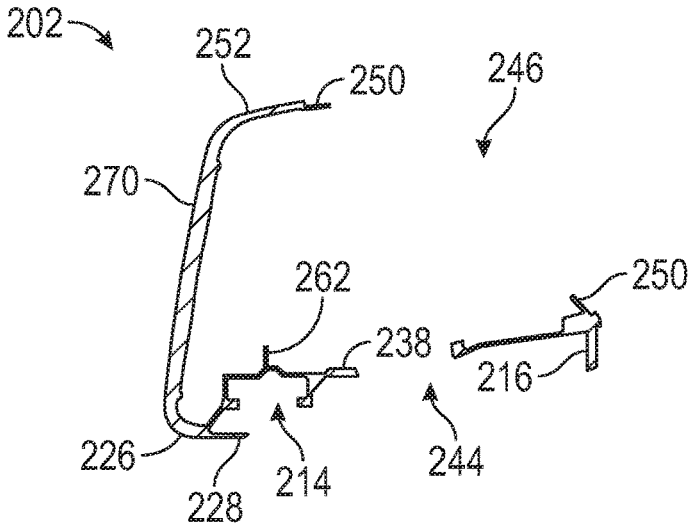
FIG. 23 is a cross-sectional view of the body taken along line 23-23 in FIG. 22.
Figure 24:
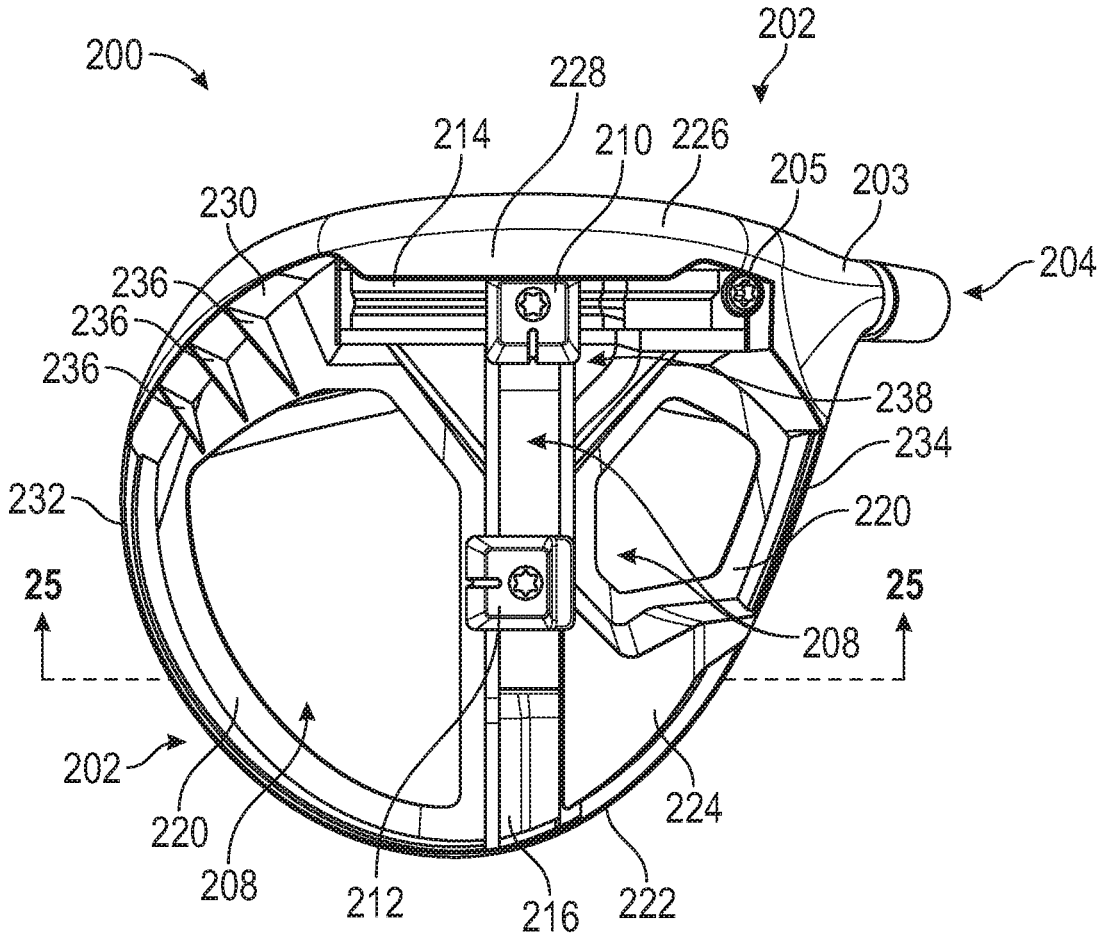
FIG. 24 is a bottom view of the golf club head of FIG. 20.
Figure 25:
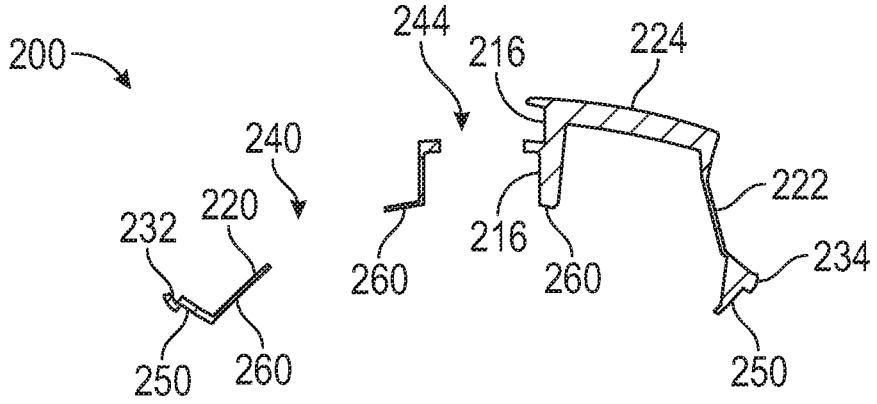
FIG. 25 is a cross-sectional view taken along line 25-25 in FIG. 24.
Figure 27:
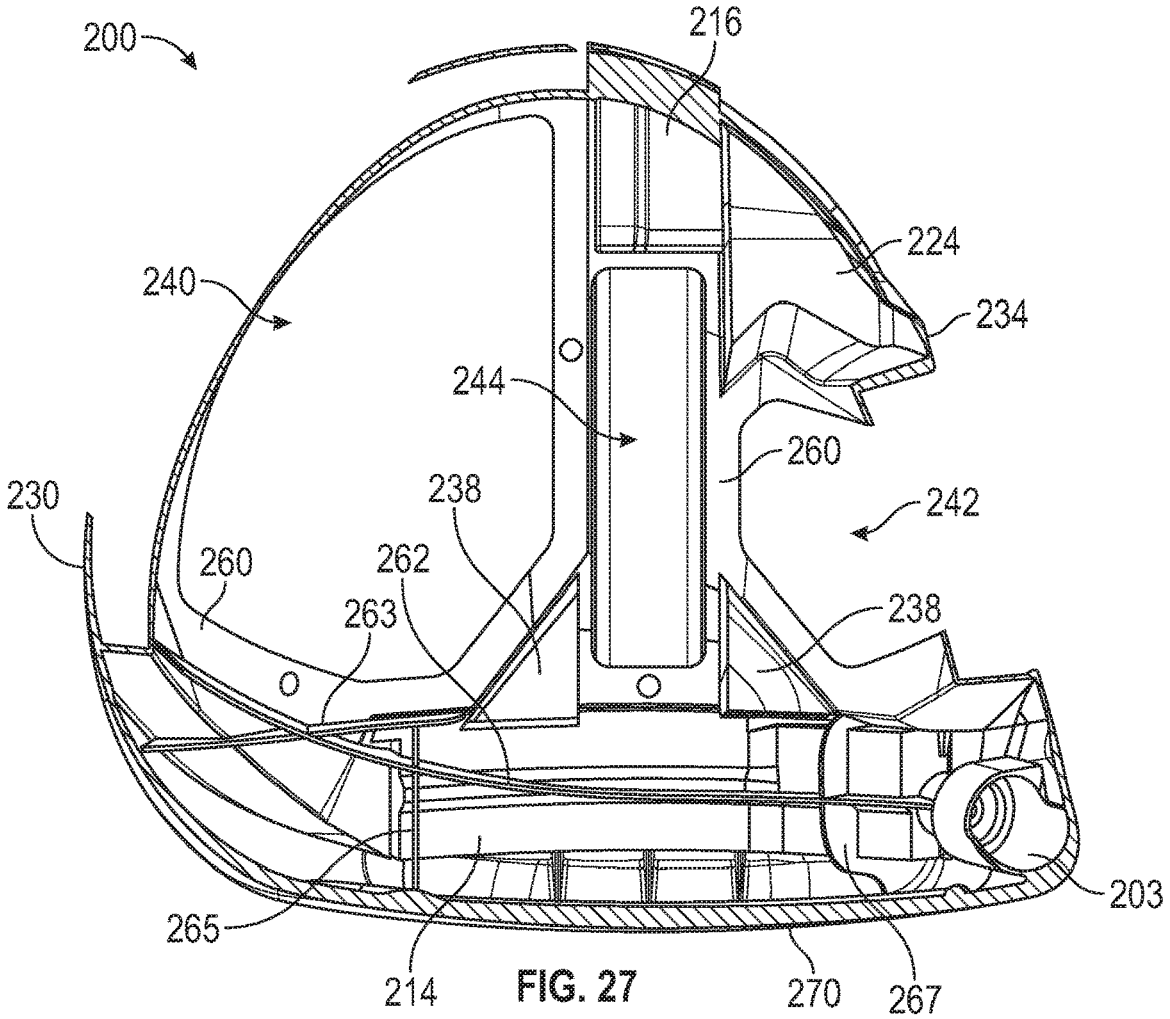
FIG. 27 is a cross-sectional top-down view of a lower portion of the body of FIG. 22.
Figure 28:
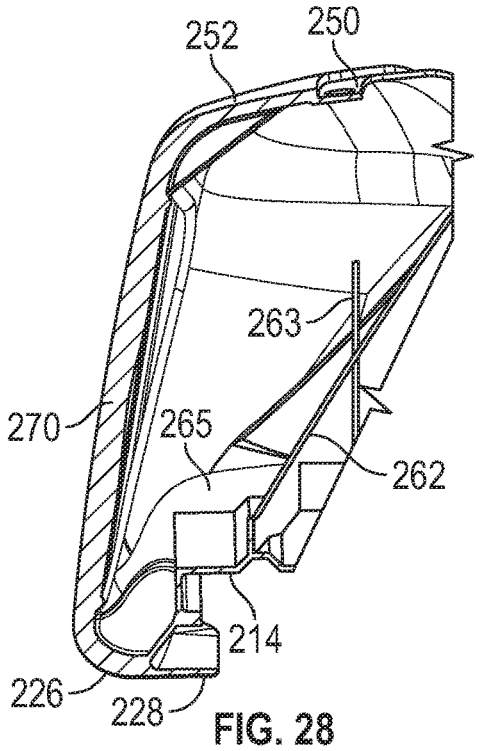
FIG. 28 is a cross-sectional side view of a toe portion of the body of FIG. 22.

The head 200 has a raised sole that is defined by a combination of the body 202 and the sole insert 208. As shown in FIGS. 22 and 27, for example, the lower portion of the body 202 include a toe-side opening 240, a heel-side opening 242, and a rear track opening 244, all of which are covered by the sole insert 208. The rear weight track 216 is positioned below the sole insert 208.

Figure 20:
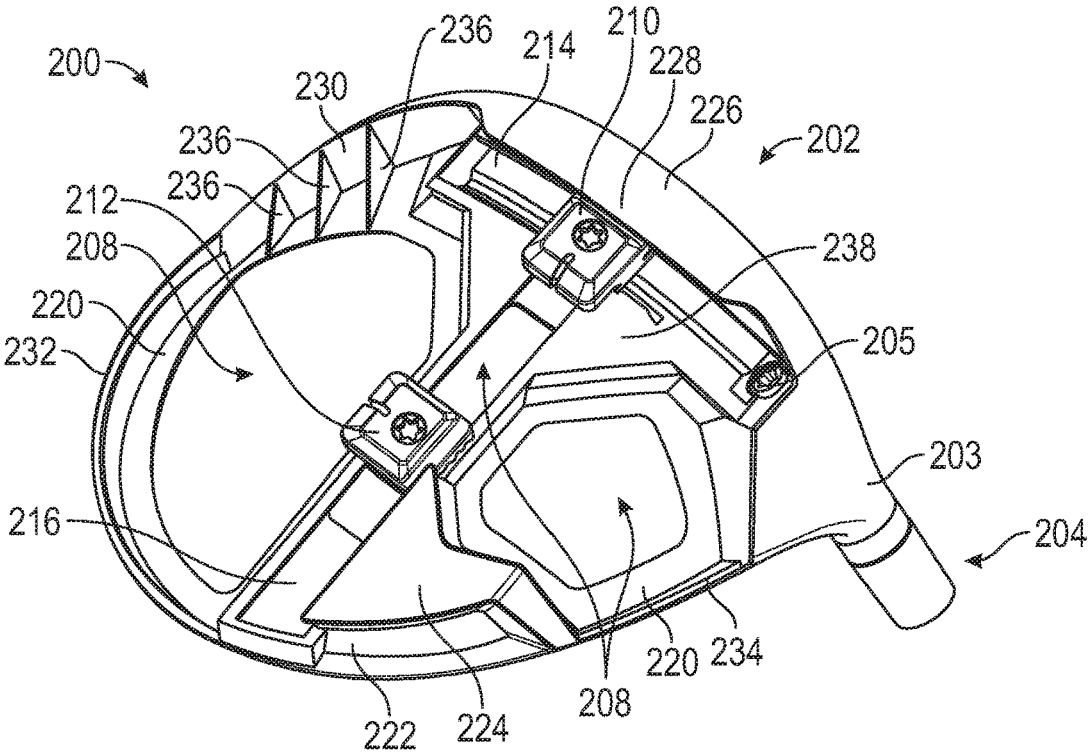
FIG. 20 is a bottom perspective view of yet another exemplary golf club head disclosed herein.
Figure 26:
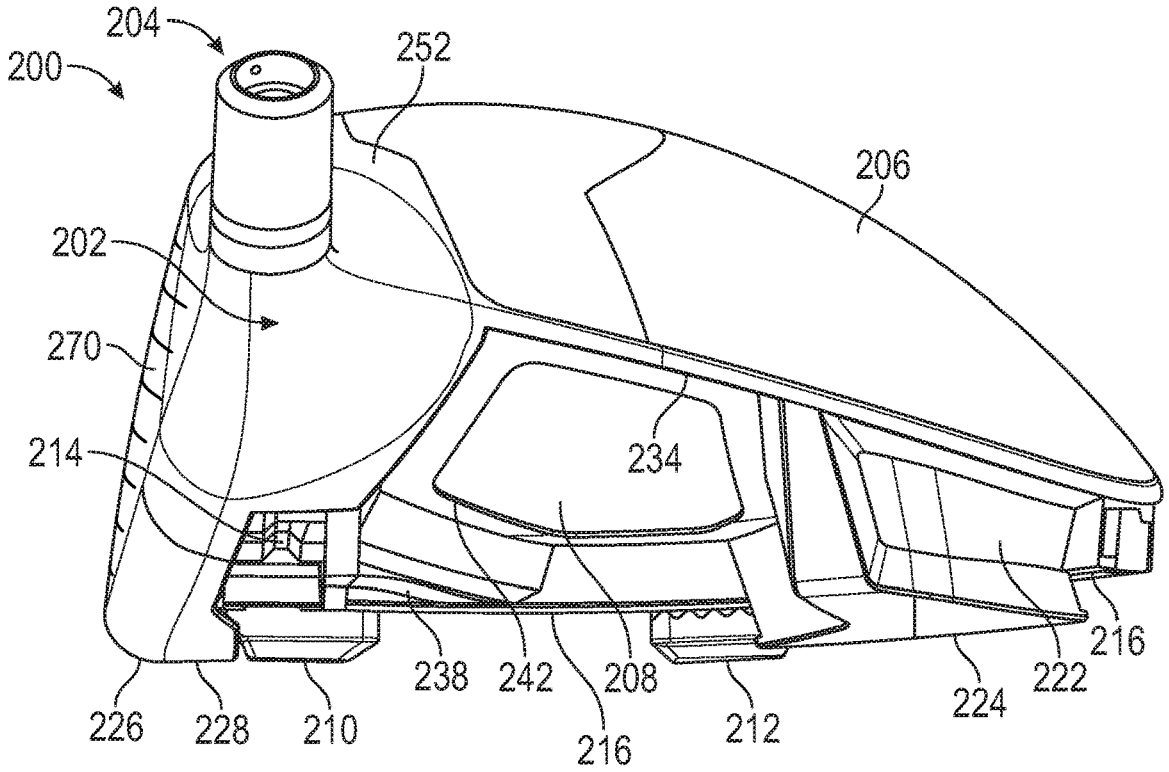
FIG. 26 is a heel side view of the golf club head of FIG. 20.
Figure 26A:
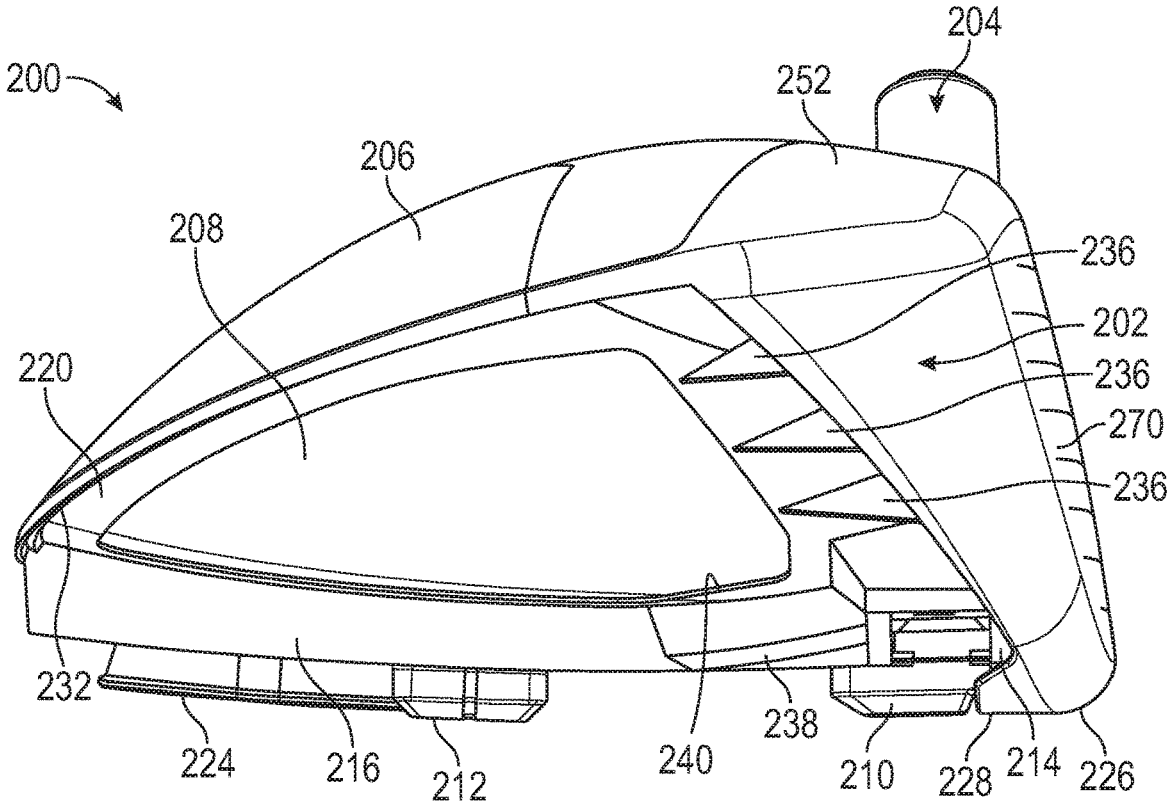
FIG. 26A is a toe side view of the golf club head of FIG. 20.

The head 200 also includes a toe-side cantilevered ledge 232 extending around the perimeter from the rear weight track 216 or rear sit pad 224 around to toe region adjacent the face, where the ledge 232 joins with a toe portion 230 of the body that extends toeward from the front sit pad 226. One or more optional ribs 236 can join the toe portion 230 to the raised sole adjacent a forward end of the toe-side opening 240 in the body. Three such triangular ribs are illustrated in FIG. 20 and FIG. 26A.

The head 200 also includes a heel-side cantilevered ledge 234 that extends from near the hosel region rearward to the rear sit pad 224 or to the rear end of the rear weight track 216. In some embodiments, the two cantilevered ledges 232 and 234 can meet and/or form a continuous ledge that extends around the rear of the head. The rear sit pad 224 can optionally include a recessed rear portion 222 (as shown in FIG. 26).

The lower portion of the body 202 that forms part of the sole can include various features, thickness variations, ribs, etc, to provide enhanced rigidity where desired and weight saving when rigidity is less desired. The body can include thicker regions 238, for example, near the intersection of the two weight tracks 214, 216. The body can also include thin ledges or seats 260 around the openings 240, 242, with the ledges 260 configured to receive and mate with sole insert 208. The lower surfaces of the body can also include various internal ribs to enhance rigidity and acoustics, such as ribs 262, 263, 265, and 267 shown in FIGS. 27 and 28.

Figure 21:
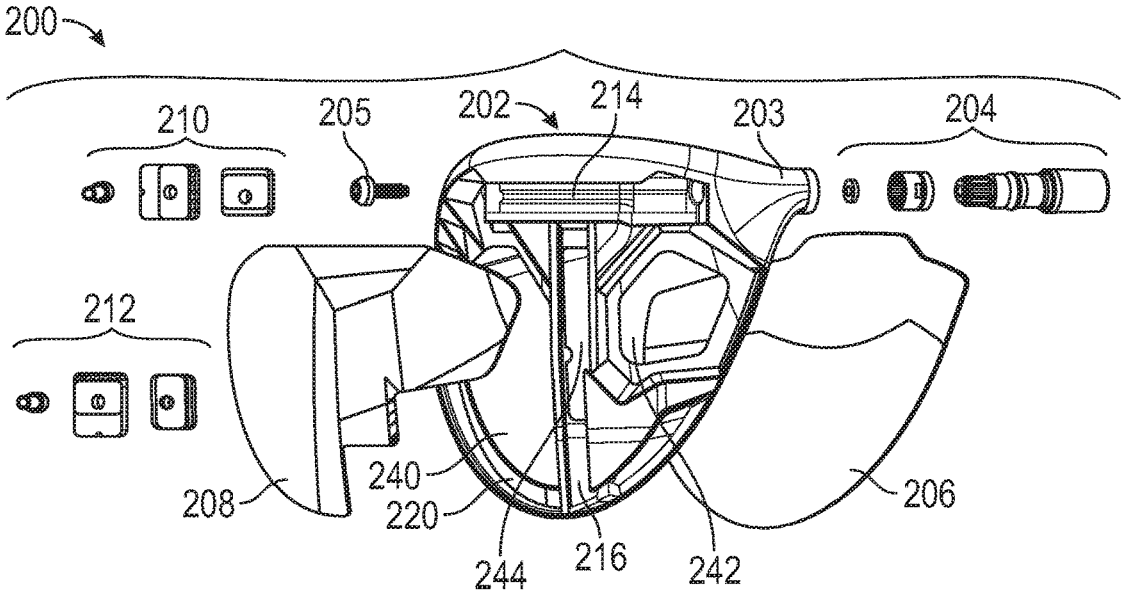
FIG. 21 is an exploded bottom perspective view of the golf club head of FIG. 20.
Figure 21A:
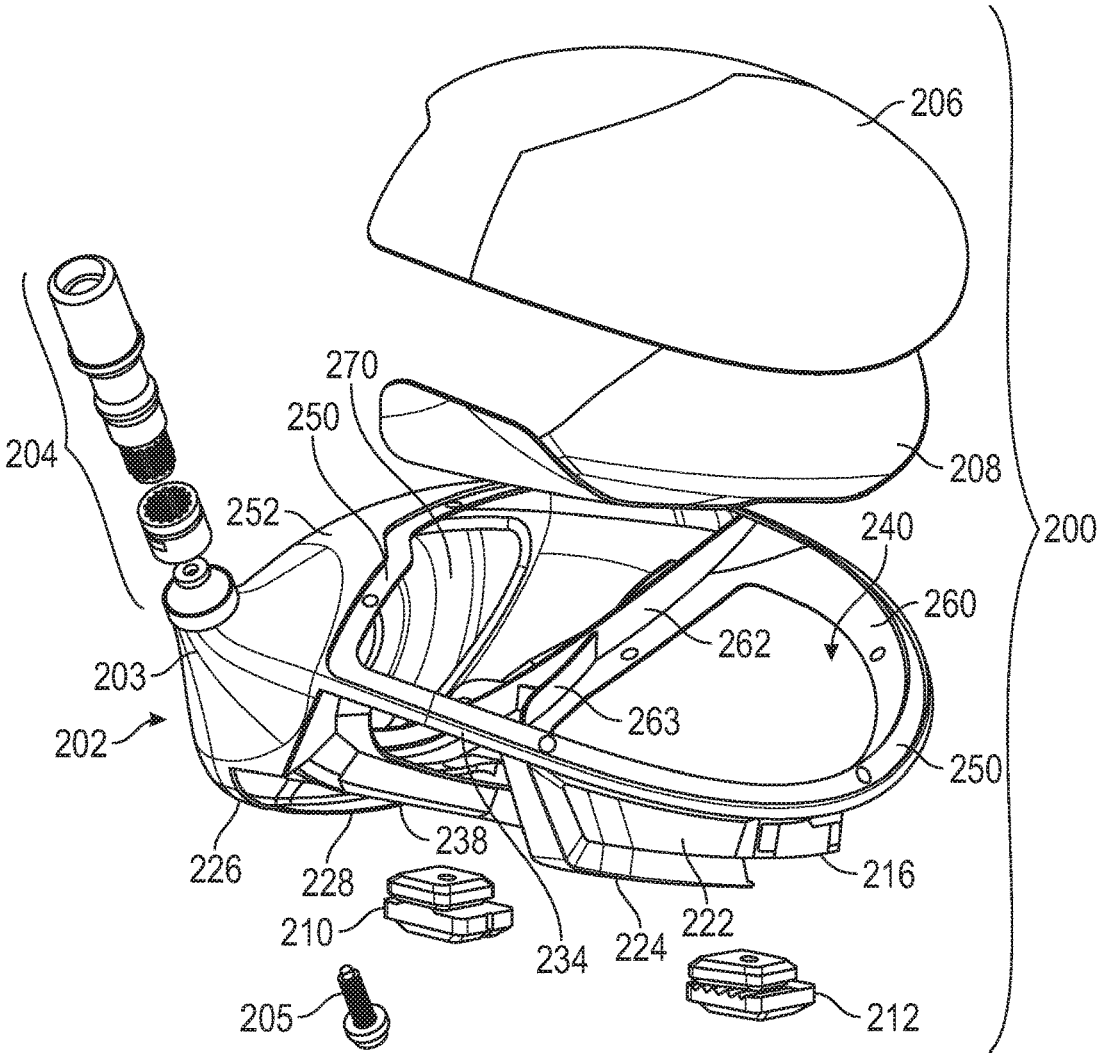
FIG. 21A is an exploded side perspective view of the golf club head of FIG. 20.

The upper portion of the body can also include various features, thickness variations, ribs, etc, to provide enhanced rigidity where desired and weight saving when rigidity is less desired. For example, the body includes a thinner seat region 250 around the upper opening to receive the crown insert 206. As shown in FIG. 21A, the seats 250 and 260 for the crown and sole inserts can be close to each other, even sharing a common edge, around the outer perimeter of the body.

Figure 36C:
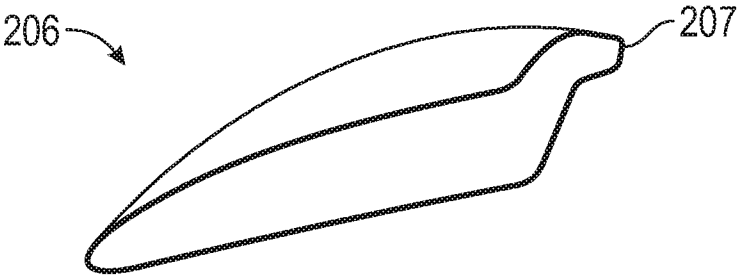
FIG. 36C is a side view of the crown portion of the golf club head of FIG. 20.
Figure 36D:
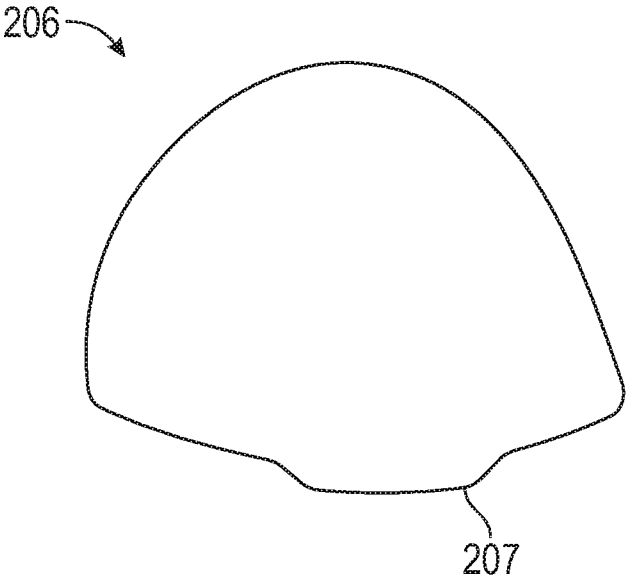
FIG. 36D is a top view of the crown portion of the golf club head of FIG. 20.
Figure 36A:
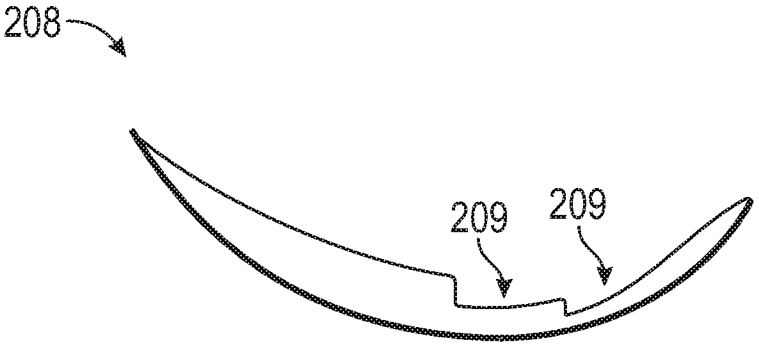
FIG. 36A is a front side view of the sole portion of the golf club head of FIG. 20.
Figure 36B:
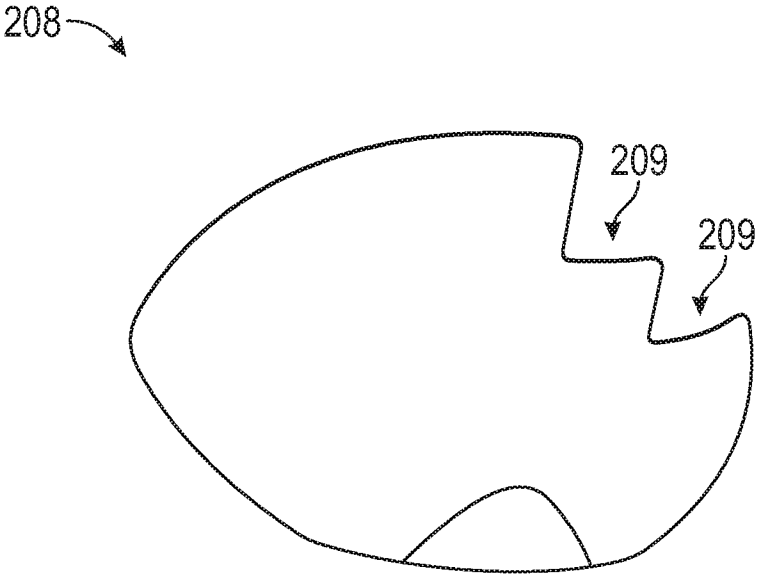
FIG. 36B is a bottom view of the sole portion of the golf club head of FIG. 20.

FIGS. 35A-D show top views of the head 200 in various states with the crown and sole inserts in place and/or removed. FIGS. 36A-D show the crown and sole inserts in more detail. As shown in FIGS. 36A and 36B, the sole insert 208 can have an irregular shape with a concave upper surface and convex lower surface. The sole insert 208 can also include notches 209 at the rear-heel end to accommodate fitting around the rear sit pad 224 area, where enhanced rigidity is needed due to ground contact forces. In various embodiments, the sole insert can cover at least about 50% of the surface area of the sole, at least about 60% of the surface area of the sole, at least about 70% of the surface area of the sole, or at least about 80% of the surface area of the sole. In another embodiment, the sole insert covers about 50% to 80% of the surface area of the sole. The sole insert contributes to a club head structure that is sufficiently strong and stiff to withstand the large dynamic loads imposed thereon, while remaining relatively lightweight to free up discretionary mass that can be allocated strategically elsewhere within the club head.

The sole insert 208 has a geometry and size selected to at least cover the openings 240, 242, 244 in the bottom of the body, and can be secured to the frame by adhesion or other secure fastening technique. In some embodiments, the ledges 260 may be provided with indentations to receive matching protrusions or bumps on the underside of the sole insert to further secure and align the sole insert on the frame.

Like the sole, the crown also has an opening 246 that reduces the mass of the body 202, and more significantly, reduces the mass of the crown, a region of the head where increased mass has the greatest impact on raising (undesirably) the CG of the head. Along the periphery of the opening 246, the frame includes a recessed ledge 250 to seat and support the crown insert 206. The crown insert 206 (see FIGS. 36C and 36D) has a geometry and size compatible with the crown opening 246 and is secured to the body by adhesion or other secure fastening technique so as to cover the opening 246. The ledge 260 may be provided with indentations along its length to receive matching protrusions or bumps on the underside of the crown insert to further secure and align the crown insert on the body. The crown insert may also include a forward projection 207 that extends in to the forward crown portion 252 of the body.

In various embodiments, the ledges of the body that receive the crown and sole inserts (e.g. ledges 250 and 260) may be made from the same metal material (e.g., titanium alloy) as the body and, therefore, can add significant mass to the golf club head. In some embodiments, in order to control the mass contribution of the ledge to the golf club head, the width of the ledges can be adjusted to achieve a desired mass contribution. In some embodiments, if the ledges add too much mass to the golf club head, it can take away from the decreased weight benefits of a sole and crown inserts, which can be made from a lighter materials (e.g., carbon fiber or graphite composites and/or polymeric materials). In some embodiments, the width of the ledges may range from about 3 mm to about 8 mm, preferably from about 4 mm to about 7 mm, and more preferably from about 4.5 mm to about 5.5 mm. In some embodiments, the width of the ledges may be at least four times as wide as a thickness of the respective insert. In some embodiments, the thickness of the ledges may range from about 0.4 mm to about 1 mm, preferably from about 0.5 mm to about 0.8 mm, and more preferably from about 0.6 mm to about 0.7 mm. In some embodiments, the thickness of the ledges may range from about 0.5 mm to about 1.75 mm, preferably from about 0.7 mm to about 1.2 mm, and more preferably from about 0.8 mm to about 1.1 mm. Although the ledges may extend or run along the entire interface boundary between the respective insert and the body, in alternative embodiments, the ledges may extend only partially along the interface boundaries.

The periphery of crown opening 246 can be proximate to and closely track the periphery of the crown on the toe-, rear-, and heel-sides of the head 200. In contrast, the face-side of the crown opening 246 can be spaced farther from the face 270 region of the head. In this way, the head can have additional frame mass and reinforcement in the crown area 252 just rearward of the face 270. This area and other areas adjacent to the face along the toe, heel and sole support the face and are subject to the relatively higher impact loads and stresses due to ball strikes on the face. As described elsewhere herein, the frame may be made of a wide range of materials, including high strength titanium, titanium alloys, and/or other metals. The opening 246 can have a notch at the front side which matingly corresponds to the crown insert projection 207 to help align and seat the crown insert on the body.

The front and rear weight tracks 214, 216 are located in the sole of the club head and define tracks for mounting two-piece slidable weight assemblies 210, 212, respectively, which may be fastened to the weight tracks by fastening means such as screws. The weight assemblies can take forms other than as shown in FIG. 21A, can be mounted in other ways, and can take the form of a single piece design or multi-piece design. The weight tracks allows the weight assemblies to be loosened for slidable adjustment along the tracks and then tightened in place to adjust the effective CG and MOI characteristics of the club head. For example, by shifting the club head's CG forward or rearward via the rear weight assembly 212, or heelward or toeward via the front weight assembly 210, the performance characteristics of the club head can be modified to affect the flight of the golf ball, especially spin characteristics of the golf ball. In other embodiments, the front weight track 214 can instead be a front channel without a movable weight.

The sole of the body 202 preferably is integrally formed with the front weight track 214 extending generally parallel to and near the face of the club head and generally perpendicular to the rear weight track 216, which extends rearward from near the middle of the front track toward the rear of the head.

In the illustrated embodiments, the weight tracks each only include one weight assembly. In other embodiments, two or more weight assemblies can be mounted in either or both of the weight tracks to provide alternative mass distribution capabilities for the club head.

By adjusting the CG heelward or toeward via the front weight track 214, the performance characteristics of the club head can be modified to affect the flight of the ball, especially the ball's tendency to draw or fade and/or to counter the ball's tendency to slice or hook. By adjusting the CG forward or rearward via the rear weight track 216, the performance characteristics of the club head can be modified to affect the flight of the ball, especially the ball's tendency to move upwardly or resist falling during flight due to backspin. The use of two weights assemblies in wither track can allow for alternative adjustment and interplay between the two weights. For example, with respect to the front track 214, two independently adjustable weight assemblies can be positioned fully on the toe side, fully on the heel side, spaced apart a maximum distance with one weight fully on the toe side and the other fully on the heel side, positioned together in the middle of the weight track, or in other weight location patterns. With a single weight assembly in a track, as illustrated, the weight adjustment options are more limited but the effective CG of the head still can be adjusted along a continuum, such as heelward or toeward or in a neutral position with the weight centered in the front weight track.

Figure 29:
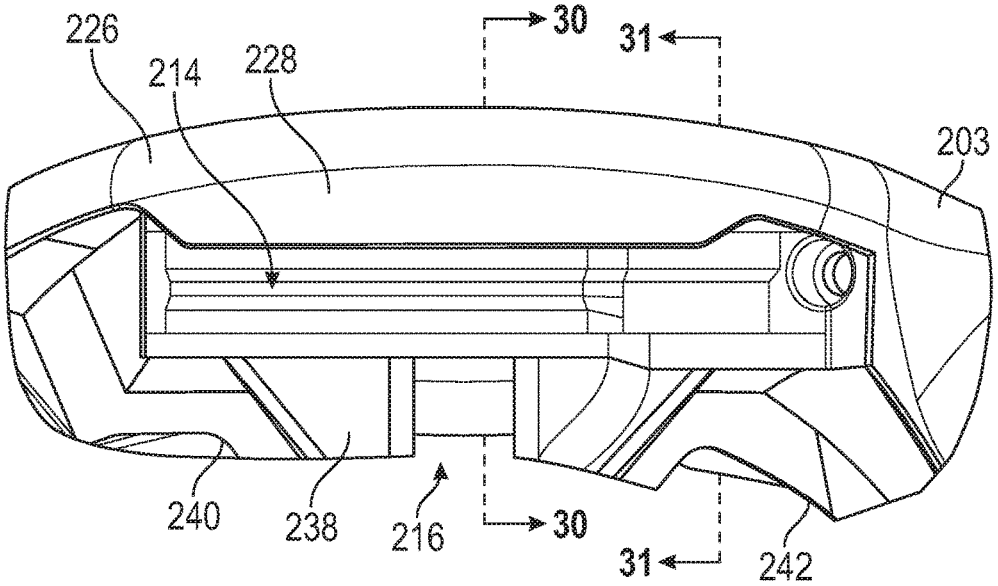
FIG. 29 is a bottom view of a front portion of the sole of the body of FIG. 22.
Figure 30:
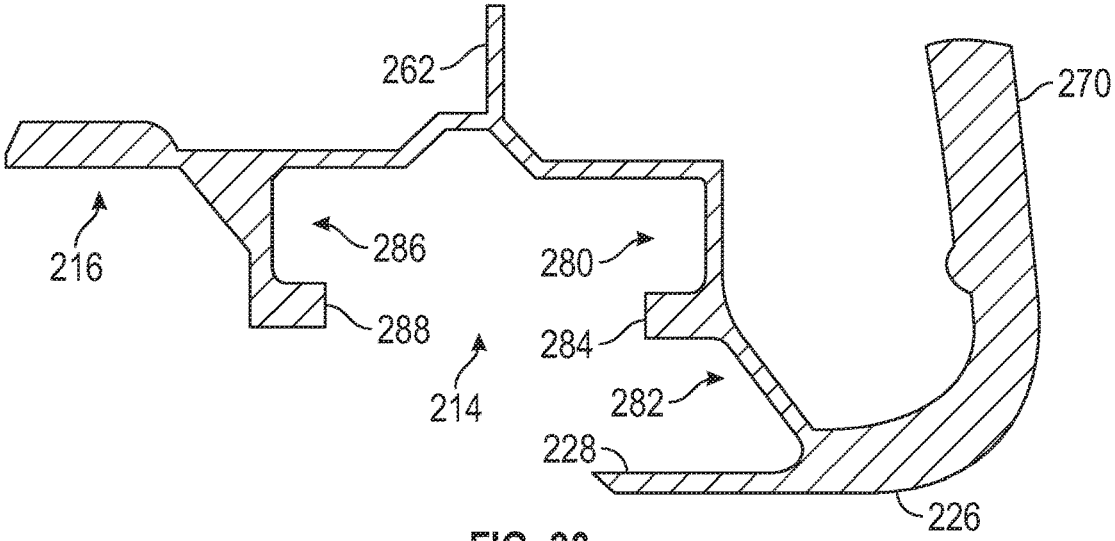
FIG. 30 is an enlarged detail cross-section view of a side-to-side weight track taken generally along line 30-30 of FIG. 29.
Figure 31:
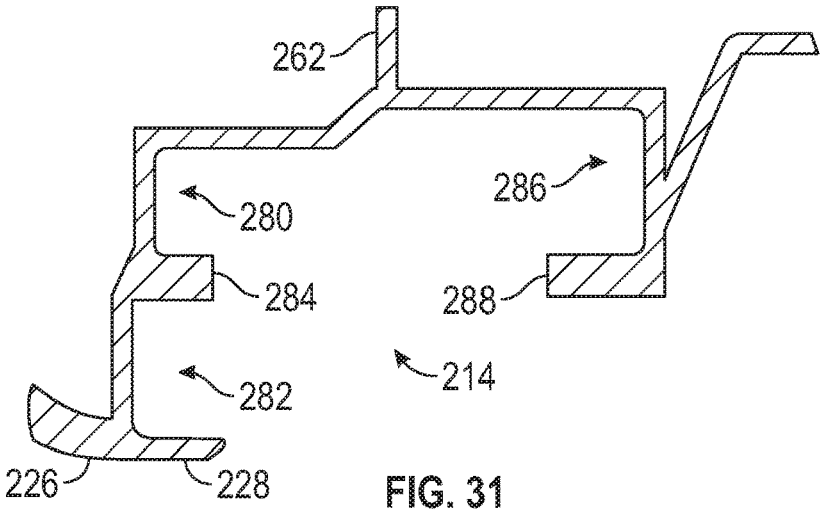
FIG. 31 is another enlarged detail cross-section view of the side-to-side weight track taken generally along line 31-31 of FIG. 29.
Figure 32:
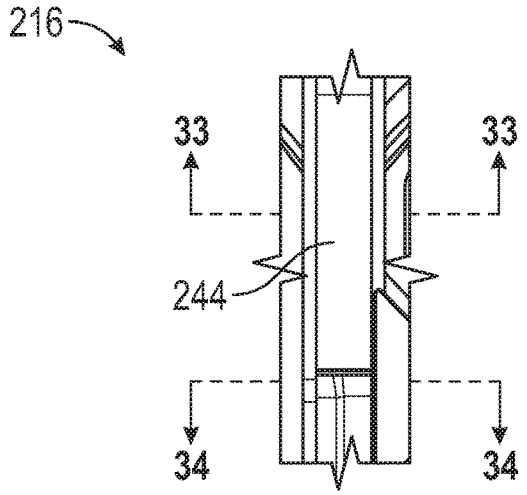
FIG. 32 is a bottom view of a portion of the sole of the body of FIG. 22 including a front-to-rear weight track.
Figure 33:
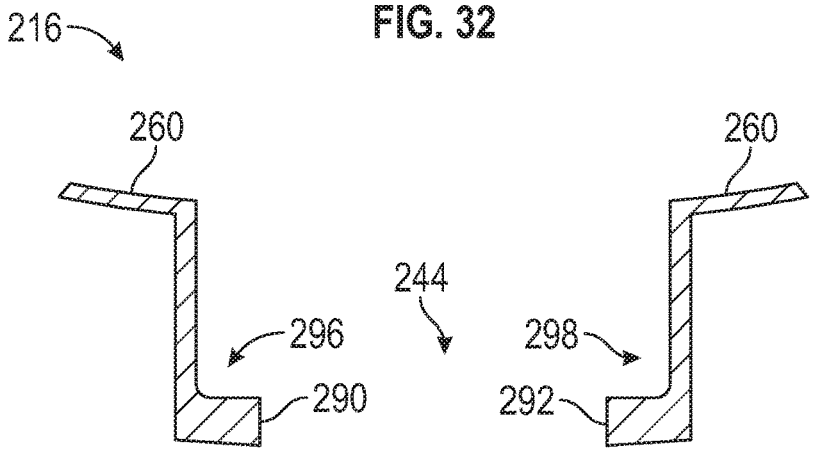
FIG. 33 is an enlarged detail cross-section view of the front-to-rear weight track taken generally along line 33-33 of FIG. 32.
Figure 34:
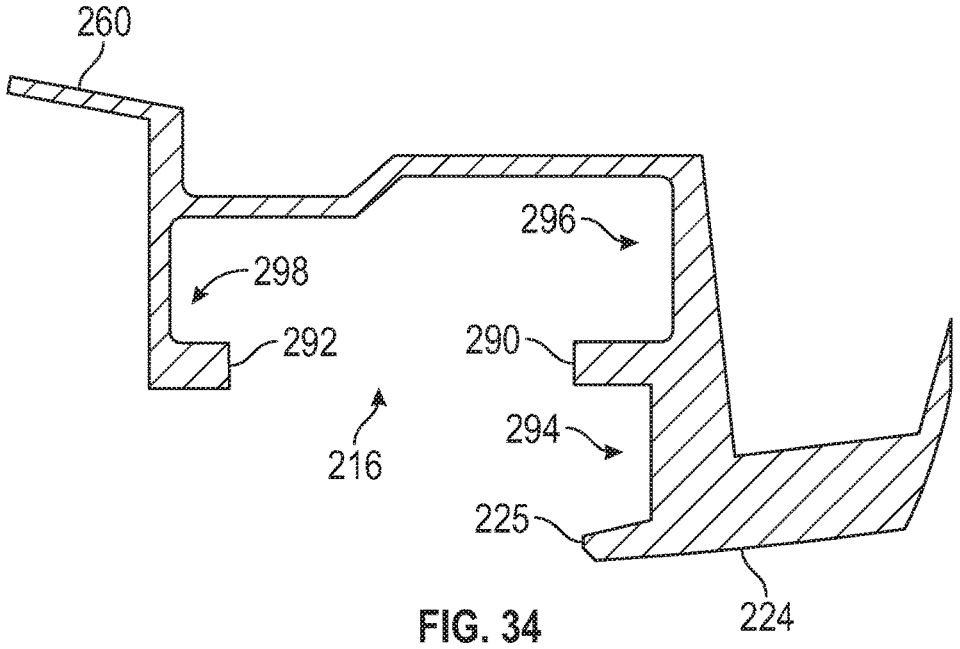
FIG. 34 is another enlarged detail cross-section view of the front-to-rear weight track taken generally along line 34-34 of FIG. 32.
Figure 35C:
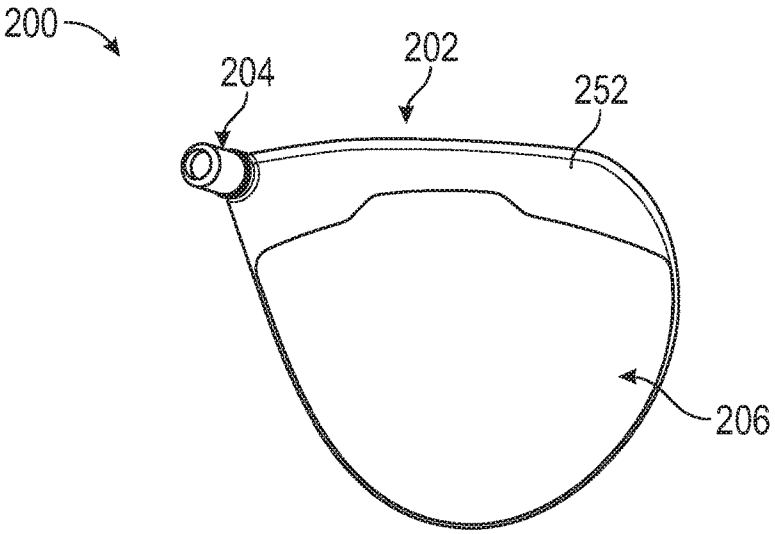
FIG. 35C is a top view of the golf club head of FIG. 20 with the crown portion in place.
Figure 35D:
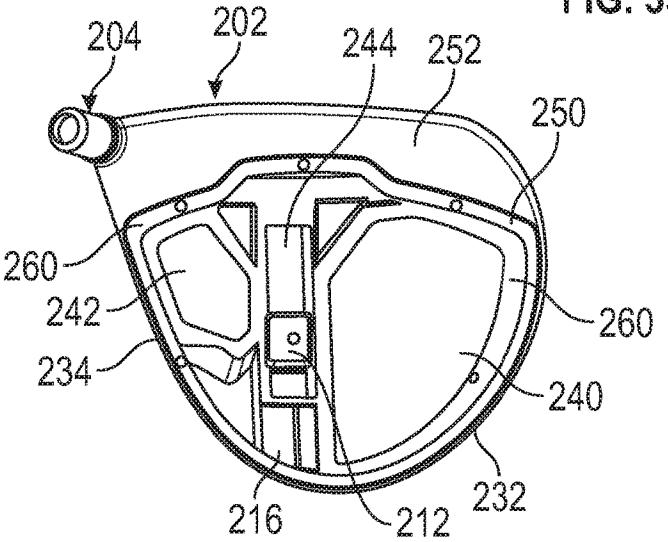
FIG. 35D is a top view of the golf club head of FIG. 20 with both the crown portion and the sole portion removed.
Figure 35A:
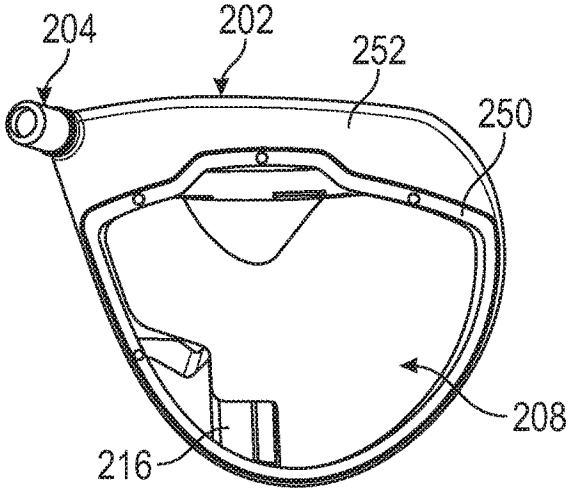
FIG. 35A is a top view of the golf club head of FIG. 20 with a crown portion removed, showing a sole portion positioned in the body.
Figure 35B:
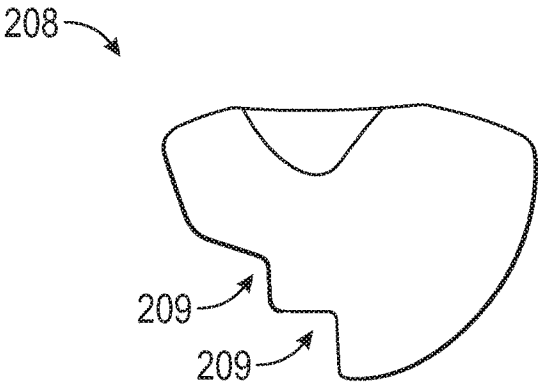
FIG. 35B is a top view of the sole portion of the golf club head of FIG. 20.

As shown in FIGS. 29-34, each of the weight tracks 214, 216 preferably has a recess, which may be generally rectangular in shape, to provide a recessed track to seat and guide the weight as it adjustably slides along the track. Each track includes one or more peripheral rails or ledges to define an elongate channel preferably having a width dimension less than the width of the weight placed in the channel. For example, as shown in FIGS. 29 and 30, the front track 214 includes opposing peripheral rails 288 and 284 and, as shown in FIGS. 33 and 34, the rear track 216 includes opposing peripheral rails 290 and 292. In this way, the weights can slide in the weight track while the rails prevent them from passing out of the tracks. At the same time, the channels between the ledges permit the screws of the weight assemblies to pass through the center of the outer weight elements, through the channels, and then into threaded engagement with the inner weight elements. The ledges serve to provide tracks or rails on which the joined weight assemblies freely slide while effectively preventing the weight assemblies from inadvertently slipping out of the tracks, even when loosened. In the front track 214, the inner weight member of the assembly 210 sits above the rails 284 and 288 in inner recesses 280 and 286, while the outer weight member is partially seated in recess 282 between the forward rail 284 and the overhanging lip 228 of the front sit pad 226 (FIGS. 30, 31). In the rear track 216, the inner weight member of the assembly 212 sits above the rails 290 and 292 in inner recesses 296 and 298, while the outer weight member can be partially seated in recess 294 between the heel-side rail 290 and an overhanding lip 225 of the rear sit pad 224.

The weight assemblies can be adjusted by loosening the screws and moving the weights to a desired location along the tracks, then the screws can be tightened to secure them in place. The weights assemblies can also be swapped out and replaced by other weight assemblies having different masses to provide further mass adjustment options. If a second or third weight is added to the weight track, many additional weight location and distribution options are available for additional fine tuning of the head's effective CG location in the heel-toe direction and the front-rear direction, and combinations thereof. This also provides great range of adjust of the club head's MOI properties.

Either or both of the weight assemblies 210, 212 can comprise a three piece assembly including an inner weight member, an outer weight member, and a fastener coupling the two weight members together. The assemblies can clamp onto front, back, or side ledges of the weight tracks by tightening the fastener such that the inner member contacts the inner side the ledge and the outer weight member contacts the outer side of the ledge, with enough clamping force to hold the assembly stationary relative to the body throughout a round of golf. The weight members and the assemblies can be shaped and/or configured to be inserted into the weight track by inserting the inner weight member into the inner channel past the ledge(s) at a usable portion of the weight track, as opposed to inserting the inner weight at an enlarged opening at one end of the weight track where the weight assembly is not configured to be secured in place. This can allow for elimination of such a wider, non-functional opening at the end of the track, and allow the track to be shorter or to have a longer functional ledge width over which the weight assembly can be secured. To allow the inner weight member to be inserted into the track in the middle of the track (for example) past the ledge, the inner weight member can be inserted at an angle that is not perpendicular to the ledge, e.g., an angled insertion. The weight member can be inserted at an angle and gradually rotated into the inner channel to allow insertion past the clamping ledge. In some embodiments, the inner weight member can have a rounded, oval, oblong, arcuate, curved, or otherwise specifically shaped structure to better allow the weight member to insert into the channel past the ledge at a useable portion of the track.

In the golf club heads of the present disclosure, the ability to adjust the relative positions and masses of the slidably adjusted weights and/or threadably adjustable weights, coupled with the weight saving achieved by titanium alloys material use and incorporation of the light-weight crown insert and/or sole insert, further coupled with the discretionary mass provided by the raised sole configurations, can allow for a large range of variation of a number properties of the club-head all of which affect the ultimate club-head performance including the position of the CG of the club-head, MOI values of the club head, acoustic properties of the club head, aesthetic appearance and subjective feel properties of the club head, and/or other properties.

In certain embodiments, the front weight track and the rear weight track have certain track widths. The track widths may be measured, for example, as the horizontal distance between a first track wall and a second track wall that are generally parallel to each other on opposite sides of the inner portion of the track that receives the inner weight member of the weight assembly. With reference to FIGS. 29-31, the width of the front track 214 can be the horizontal distance between opposing walls of the inner recesses 280 and 286. With reference to FIGS. 32-34, the width of the rear track 216 can be the horizontal distance between opposing walls of the inner recesses 296 and 298. For both the front track and the rear track, the track widths may be between about 5 mm and about 20 mm, such as between about 10 mm and about 18 mm, or such as between about 12 mm and about 16 mm. According to some embodiments, the depth of the tracks (i.e., the vertical distance between the uppermost inner wall in the track and an imaginary plane containing the regions of the sole adjacent the outermost lateral edges of the track) may be between about 6 mm and about 20 mm, such as between about 8 mm and about 18 mm, or such as between about 10 mm and about 16 mm. For the front track 214, the depth of the track can be the vertical distance from the inner surface of the overhanging lip 228 to the upper surface of the inner recess 280 (FIG. 30). For the rear track 216, the depth of the track can be the vertical distance from the inner surface of the overhanging lip 225 to the upper surface of the inner recess 296 (FIG. 34).

Additionally, both the front track and rear track have a certain track length. Track length may be measured as the horizontal distance between the opposing longitudinal end walls of the track. For both the front track and the rear track, their track lengths may be between about 30 mm and about 120 mm, such as between about 50 mm and about 100 mm, or such as between about 60 mm and about 90 mm. Additionally, or alternatively, the length of the front track may be represented as a percentage of the striking face length. For example, the front track may be between about 30% and about 100% of the striking face length, such as between about 50% and about 90%, or such as between about 60% and about 80% mm of the striking face length.

The track depth, width, and length properties described above can also analogously also be applied to the front channel 36 of the club head 10. In FIGS. 30 and 34, it can be seen that the lips 228, 225 of the front and rear sit pads extend over or overhang the respective weight tracks, restricting the track openings and helping retain the weight (s) within the tracks.

Referring to FIG. 34, the sole area on the rear sit pad 224 on the heel side of the rear track 216 is lower than the sole area on the toe side (bottom of ledge 292) by a significant vertical distance when the head is in the address position relative to a ground plane. This can be thought of as the head having a "dropped sole" or "raised sole" construction with a portion of the sole positioned lower (e.g., on the heel side) relative to another portion of the sole (e.g., on the toe side). Put another way, a portion of the sole (e.g., most of the sole except for the rear sit pad 224) is raised relative to another portion of the sole (e.g., the rear sit pad). The same also applies at the front track 214 where the front sit pad 226 and its lip 228 are significantly lower than the rear side of the front track (as shown in FIG. 30), in the normal address position.

In one embodiment, the vertical distance between the level of the ground contact surfaces of the sit pads and the adjacent surfaces of the raised sole portions may be in the range of about 2-12 mm, preferably about 3-9 mm, more preferably about 4-7 mm, and most preferably about 4.5-6.5 mm. In one example, the vertical distance is about 5.5 mm.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims. We therefore claim all that comes within the scope of these claims.

The invention claimed is:

1. A wood-type golf club head body comprising:

a crown, a sole, skirt, a face plate, and a hosel;

the body defining a hollow interior region and at least one opening in the crown or sole providing access to the hollow interior region, wherein the body is configured to form a golf club head having a volume of between approximately 300 $cm^3$ and approximately 490 $cm^3$;

the body being cast substantially entirely of 9-1-1 titanium, wherein the 9-1-1 titanium comprises molybdenum, vanadium, and aluminum, and wherein the 9-1-1 titanium has a tensile strength of at least 958 MPa, inclusive; and the body being cast as a single unitary casting, with the face plate being formed integrally with the crown, sole, skirt, and hosel, wherein a minimum thickness of the face plate is less than 2.5 mm and a maximum thickness of the face plate is greater than the minimum thickness and less than 5.0 mm;

wherein the face plate is not chemically etched and has an alpha case thickness of 0.30 mm or less.

2. The golf club head body of claim 1, wherein the 9-1-1 titanium comprises a combined amount of molybdenum and vanadium no less than 1.7% and no more than 2.4%.

3. The golf club head body of claim 2, wherein the 9-1-1 titanium comprises aluminum in an amount no less than 8.5%.

4. The golf club head body of claim 3, wherein the body comprises substantially no fluorine atoms.

5. The golf club head body of claim 4, wherein the face plate has an alpha case thickness of 0.15 mm or less.

6. The golf club head body of claim 4, wherein the face plate has an alpha case thickness of 0.07 mm or less.

7. The golf club head body of claim 1, further comprising:

at least one channel configured to house at least one movable weight.

8. The golf club head body of claim 1, wherein the body defines an opening in the crown and the golf club head body further comprises a composite insert covering the opening in the crown.

9. The golf club head body of claim 1, wherein the body defines an opening in the sole and the golf club head body further comprises a composite insert covering the opening in the sole.

10. The golf club head body of claim 1, wherein the combined amount of molybdenum, vanadium, and aluminum is between 10.2% and 11.9%.

11. The golf club head body of claim 1, wherein the 9-1-1 titanium comprises vanadium in an amount no more than 1.3%.

12. The golf club head body of claim 1, further comprising at least one weight attachable to the golf club head.

13. The golf club head body of claim 12, wherein at least one weight is movable from a first position to a second position.

14. The golf club head body of claim 13, wherein the first position is toeward of the second position.

15. The golf club head body of claim 13, wherein the first position is rearward of the second position.

16. The golf club head body of claim 1, further comprising at least one channel configured to house at least one movable weight.

17. The golf club head body of claim 1, wherein the minimum thickness is no less than 1.5 mm.

18. The golf club head body of claim 17, wherein a central portion of the face plate is less than the maximum thickness of the face plate.

19. The golf club head body of claim 1, further comprising an adjustable head-shaft connection assembly.

20. The golf club head body of claim 1, further comprising three or more internal ribs.

21. A wood-type golf club head body comprising:

a crown, a sole, skirt, a face plate, and a hosel;

the body defining a hollow interior region and having at least one opening providing access to the hollow interior region, wherein the body is configured to form a golf club head having a volume of between approximately 300 $cm^3$ and approximately 490 $cm^3$;

the body being cast substantially entirely of 9-1-1 titanium, wherein the 9-1-1 titanium comprises molybdenum, vanadium, and aluminum, and wherein the 9-1-1 titanium has a tensile strength of at least 958 MPa, inclusive; and the body being cast as a single unitary casting, with the face plate being formed integrally with the body, wherein a minimum thickness of the face plate is less than 2.5 mm and a maximum thickness of the face plate is greater than the minimum thickness and less than 5.0 mm;

wherein the 9-1-1 titanium comprises a combined amount of molybdenum and vanadium no less than 1.7% and no more than 2.4%, and aluminum in an amount no less than 8.5%.

22. The golf club head body of claim 21, wherein the 9-1-1 titanium comprises molybdenum in an amount no less than 0.8%, and wherein the face plate has a variable thickness, the face plate is not chemically etched, and the face plate has an alpha case thickness of no more than 0.30 mm.

23. The golf club head body of claim 22, further comprising an adjustable head-shaft connection assembly.

* * * * *